US010223987B2

(12) United States Patent
Verbeure

(10) Patent No.: US 10,223,987 B2
(45) Date of Patent: Mar. 5, 2019

(54) REGIONAL DC BALANCING FOR A VARIABLE REFRESH RATE DISPLAY PANEL

(71) Applicant: NVIDIA Corporation, Santa Clara, CA (US)

(72) Inventor: Tom Verbeure, Sunnyvale, CA (US)

(73) Assignee: NVIDIA Corporation, Santa Clara, CA (US)

( * ) Notice: Subject to any disclaimer, the term of this patent is extended or adjusted under 35 U.S.C. 154(b) by 469 days.

(21) Appl. No.: 14/929,052

(22) Filed: Oct. 30, 2015

(65) Prior Publication Data

US 2017/0124965 A1 May 4, 2017

(51) Int. Cl.
*G09G 3/36* (2006.01)

(52) U.S. Cl.
CPC ..... *G09G 3/3614* (2013.01); *G09G 3/3611* (2013.01); *G09G 2320/0204* (2013.01); *G09G 2320/0247* (2013.01); *G09G 2340/0435* (2013.01)

(58) Field of Classification Search
CPC ..... G09G 3/3614; G09G 3/3611; G09G 2340/0435; G09G 2320/0204; G09G 2320/0247
See application file for complete search history.

(56) References Cited

U.S. PATENT DOCUMENTS

2008/0309656 A1* 12/2008 Van Woudenberg ..... G09G 3/3614 345/214
2014/0092150 A1* 4/2014 Slavenburg ..... G09G 5/001 345/698
2015/0194111 A1 7/2015 Slavenburg et al.
2015/0379918 A1* 12/2015 Tann ..... G09G 3/2092 345/209
2016/0232833 A1* 8/2016 Wang ..... G09G 3/2092
2016/0343318 A1* 11/2016 Wang ..... G09G 3/3614
2017/0092210 A1* 3/2017 Tann ..... G09G 3/3614

OTHER PUBLICATIONS

Verbeure, T. et al., U.S. Appl. No. 14/720,563, filed May 22, 2015.

* cited by examiner

*Primary Examiner* — Patrick N Edouard
*Assistant Examiner* — Joseph P Fox
(74) *Attorney, Agent, or Firm* — Zilka-Kotab, PC

(57) ABSTRACT

A method, computer program product, and system perform DC balancing for a variable refresh rate display panel based on regions. A first portion of a first image is displayed on a first region of a screen of a display device using a spatial inversion pattern and a first polarity of a temporal polarity pattern for the first region of the screen of the display device. A second polarity of a second temporal polarity pattern for a second region of the screen of the display device is determined and a second portion of the first image is displayed on the second region of the screen of the display device using the spatial inversion pattern and the second polarity of the second temporal polarity pattern.

18 Claims, 16 Drawing Sheets

Fixed Polarity Spatial Inversion Pattern
260

| | | | | | | | | | | | | | | | | | | | | |
|---|---|---|---|---|---|---|---|---|---|---|---|---|---|---|---|---|---|---|---|---|
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |

Inverted Fixed Polarity Spatial Inversion Pattern
265

| | | | | | | | | | | | | | | | | | | | | |
|---|---|---|---|---|---|---|---|---|---|---|---|---|---|---|---|---|---|---|---|---|
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |
| - | + | - | + | - | + | - | + | - | + | - | + | - | + | - | + | - | + | - | + | - |
| + | - | + | - | + | - | + | - | + | - | + | - | + | - | + | - | + | - | + | - | + |

*Fig. 2D*
*(PRIOR ART)*

REGIONAL DC BALANCING FOR A VARIABLE REFRESH RATE DISPLAY PANEL

FIELD OF THE INVENTION

The present invention relates to display systems, and more particularly to regional DC balancing for a variable refresh rate display panel.

BACKGROUND

Conventional display devices (e.g., Cathode Ray Tube (CRT), Liquid Crystal Displays (LCD), Light Emitting Diode (LED), Organic LED (OLED), Active-Matrix OLED (AMOLED), etc.) operate at fixed refresh rates such as 60 Hz, 85 Hz, or 120 Hz. However, a graphics processing unit (GPU) may generate frames of pixel data at a variable rendering rate that is asynchronous with the fixed refresh rate of the display device.

Newer display devices may be configured to operate synchronously with the GPU utilizing a dynamic refresh frequency. For example, some monitors may be compatible with NVIDIA's G-SYNC™ technology that enables the display device to synchronize the refresh of pixel elements for displaying a frame with the variable rendering rate of the GPU. The GPU is configured to transmit frames of pixel data to the display device via the video interface as the frames are rendered, and the display device is configured to refresh the pixels of the display device in response to receiving the frames of pixel data rather than at a fixed frequency refresh rate. In other words, the refresh rate of the display device is not fixed at a particular frequency, but instead adjusts dynamically to the rate image data is received from the GPU.

As long as the GPU renders frames of image data at a reasonably fast rendering rate, the types of image artifacts associated with conventional systems may be reduced. However, in some cases, the GPU may have trouble rendering particular frames in a reasonable amount of time due to the complexity of a scene. For example, a particular frame of pixel data may take, e.g., 100 ms to be rendered, which corresponds to a dynamic refresh frequency of 10 Hz for that particular frame. The effective refresh rate of the monitor when there are large delays between successive frames may cause issues.

For example, most image display technologies (e.g., LCD panels) have a lower and upper bound refresh frequency at which the display can reproduce an image with maximum quality. When the displays were driven at a fixed frequency refresh rate, this operational restriction was easy to meet because the fixed refresh frequency could be selected within the lower and upper bounds of the display. However, when using a variable refresh rate technology, such as NVIDIA's G-SYNC™ technology, the GPU may require a variable and unpredictable amount of time to generate the next image data for display. The amount of time required to generate the next frame of image data for display can be larger than the amount of time available while staying above the minimum refresh frequency requirements of the display.

When the refresh rate of the video signal that is arriving at the display driving hardware is lower than this minimum refresh rate, the display driving hardware needs to refresh the panel by repainting the previous image to stay above the minimum refresh frequency. FIG. 1A illustrates an example of image repetition on a variable refresh display device to avoid flicker, in accordance with the prior art. A set of timing diagrams 100 in FIG. 1A includes an input signal that includes encoded data for five images (e.g., Image 1, Image 2, Image 3, Image 4, and Image 5) received by a variable refresh display device. An output signal includes data sent to an LCD panel of the variable refresh display device. Images 1, 2, and 3 are received at a frequency that is above the minimum refresh frequency of the variable refresh display device. Therefore, Images 1, 2, and 3 are output to the LCD panel when those images are received. However, Image 4 is not received soon enough to satisfy the minimum refresh frequency of the variable refresh display device. Therefore, Image 3 is redisplayed. Then, Images 4 and 5 are output to the LCD panel when those images are received by the variable refresh display device.

If the new image (e.g., Image 4) arrives while the previous image (e.g., Image 3) is being redisplayed, a temporal collision occurs: the incoming image needs to be displayed as soon as possible for the best possible visual representation and to avoid stutter, but the previous image is in the process of being displayed. For a traditional LCD panel, display of the previous image needs to be completed before the new image can be displayed.

FIG. 1B illustrates an example of image repetition on a variable refresh display device with a temporal collision between two images, in accordance with the prior art. An output signal includes data sent to an LCD panel of the variable refresh display device. Images 1, 2, and 3 are received at a frequency that is above the minimum refresh frequency of the variable refresh display device. Therefore, Images 1, 2, and 3 are output to the LCD panel when those images are received. However, Image 4 is not received soon enough to satisfy the minimum refresh frequency of the variable refresh display device. Therefore, Image 3 is redisplayed. Image 4 is received while Image 3 is being redisplayed—causing a temporal collision between the repeated Image 3 and new Image 4. Display of Image 4 is delayed until the display of repeated Image 3 is completed. Then, Image 5 is output to the LCD panel when it is received by the variable refresh display device.

On an LCD panel, the value of a component of a pixel (for convenience, 'pixel') is determined by applying a voltage to the pixel. The absolute value of this voltage determines the color. However, applying a value of the same polarity will result in the build-up of a residual charge, also called DC imbalance. When too large, this DC imbalance can result in visual artifacts such a flicker. The build-up of DC imbalance can be prevented by alternating a positive or a negative polarity for each frame in a sequence, thus keeping the residual charge close to zero.

Conventionally, LCD panels already have a fixed pattern by which neighboring pixels may have the opposite polarity from each other. The fixed pattern defined for an LCD panel, is often called the spatial inversion pattern. Importantly, in the context for LCD panels, 'polarity' is a relative term: some pixels may have + (positive) polarity and others may have '−' (negative) polarity, and, for a different frame, the pixels are all switched to the opposite polarity. In other words, the spatial inversion pattern is defined for displaying each frame and the polarity for neighboring pixels or even for the color components within pixels may be different. However, the absolute value (e.g., positive or negative) of the polarity does not cause the DC imbalance. The DC imbalance is caused by a duration imbalance between opposing polarities for the same pixel (or same pixel color component). Ideally, to ensure DC balance is maintained, the amount of time a pixel is displayed using a negative polarity should equal the amount of time a pixel is displayed using a positive polarity. When the frame rate is fixed, DC balance is maintained by switching the polarity for all of the pixels in the entire display screen each time an image is displayed. A first pixel that starts with a positive polarity according to the spatial inversion pattern switches back and forth between positive and negative polarity for equal durations. A second pixel that is adjacent to the first pixel and starts with a negative polarity according to the spatial inversion pattern also switches back and forth between positive and negative polarity for equal durations, so DC balance is maintained for both the first and second pixels.

However, for a variable refresh rate display, just alternating the polarity for each frame is often not sufficient to keep the residual charge limited. The frame rate is not constant and there may be frame rate patterns that still result in a DC imbalance. Thus, there is a need for addressing these issues and/or other issues associated with the prior art.

SUMMARY

A method, computer program product, and system perform DC balancing for a variable refresh rate display panel based on regions. A first portion of a first image is displayed on a first region of a screen of a display device using a spatial inversion pattern and a first polarity of a temporal polarity pattern for the first region of the screen of the display device. A second polarity of a second temporal polarity pattern for a second region of the screen of the display device is determined and a second portion of the first image is displayed on the second region of the screen of the display device using the spatial inversion pattern and the second polarity of the second temporal polarity pattern.

BRIEF DESCRIPTION OF THE DRAWINGS

FIG. 2D illustrates an example fixed polarity spatial inversion pattern, in accordance with the prior art;

DETAILED DESCRIPTION

DC balance can be maintained by alternating a positive or a negative polarity for successive frames when the frame rate is constant. In some cases, the residual charge may be kept close to zero when the frame rate varies for a variable rate refresh display device. However, some flat panel display devices support an 'abort-rescan operation,' allowing the refresh of an image being redisplayed to refresh the display to be interrupted (i.e., aborted) when a new image is ready so that the new image can be displayed right away (i.e., before the entire previous image is repainted). While the abort-rescan technique reduces the delay for displaying a new image, a new problem is created: non-uniform DC imbalance for different locations of the display screen. When the abort-rescan technique is used, alternating a positive and negative polarity for each frame is unlikely to maintain DC balance. Separately controlling the switching of the polarity for different regions of a variable refresh display device, better maintains DC balance. Rather than switching or reversing the polarity for an entire frame, the polarity may be reversed within a frame by separately controlling the polarity used to display each region of a display screen, as described further herein.

Figure 2A:
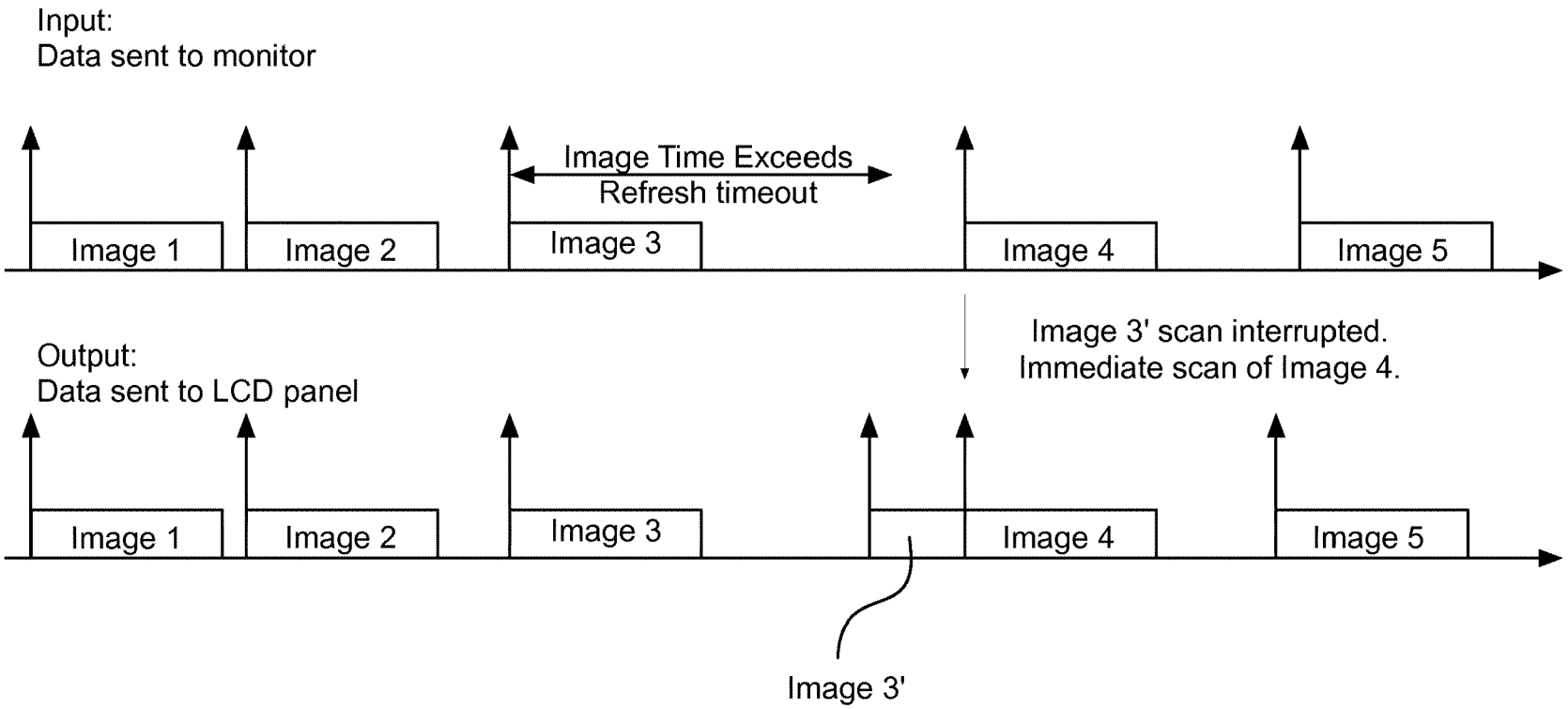
FIG. 2A illustrates an example of interrupted image repetition on a variable refresh display device, in accordance with one embodiment.

FIG. 2A illustrates an example 200 of interrupted image repetition on a variable refresh display device, in accordance with one embodiment. An output signal includes data sent to an LCD panel of the variable refresh display device. Images 1, 2, and 3 are received at a frequency that is above the minimum refresh frequency of the variable refresh display device. Therefore, Images 1, 2, and 3 are output to the LCD panel when those images are received. However, Image 4 is not received soon enough to satisfy the minimum refresh frequency of the variable refresh display device. Therefore, Image 3 is redisplayed (shown as Image 3').

A refresh timeout corresponding to the minimum refresh frequency associated with the variable refresh rate display device may be specified based on one or more of an image rendering rate at which images are rendered by the GPU (i.e., the inverse of the image duration), a target frame rate specified by a user or environmental conditions (e.g., power consumption, temperature, etc.). It will be appreciated that, a specified lower bound for the refresh frequency of a display device corresponds to a maximum allowed frame duration. An upper bound for the refresh frequency may also be specified for the display device, where the upper bound corresponds to a minimum allowed frame duration. The refresh timeout ensures that the minimum refresh frequency is met and is less than or equal to the inverse of the minimum refresh frequency. The frame duration is associated with the display device whereas an image duration is associated with the GPU. The frame duration is the amount of time that an image is displayed before the display device is refreshed. The image duration is the amount of time during which an image is rendered by the GPU. The image duration may also include the amount of time needed to store the image into a frame buffer. The image duration may vary for one or more images in a sequence of images.

Figure 1A:
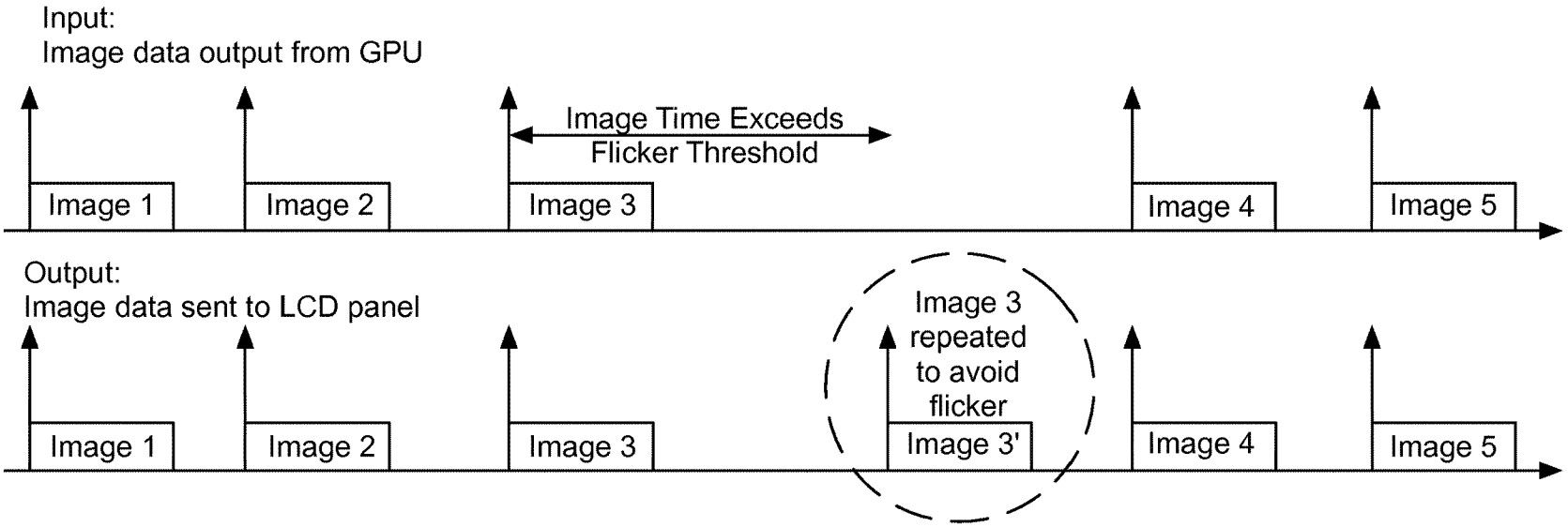
(PRIOR ART) Fig. 1A
FIG. 1A and 1B illustrate an example of image repetition on a variable refresh display device to avoid flicker, in accordance with the prior art.
Figure 1B:
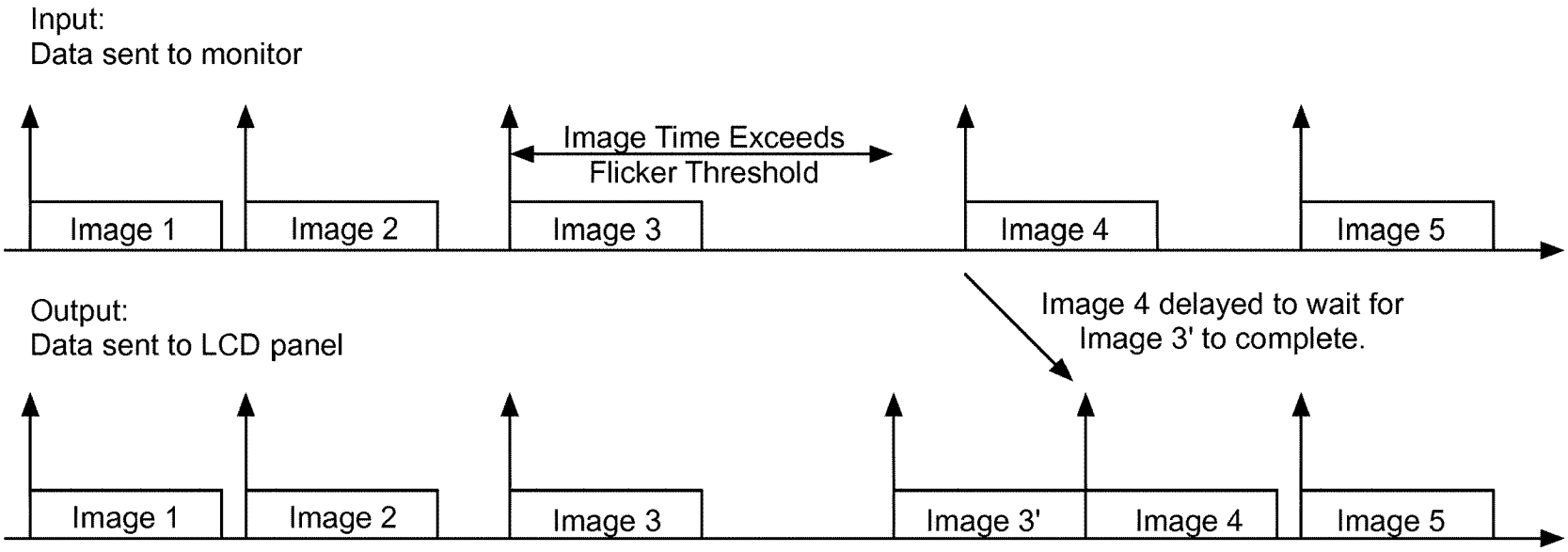
(PRIOR ART) Fig. 1B

As shown in FIG. 2A, Image 4 is received while Image 3 is being redisplayed—causing a temporal collision between the repeated Image 3 (e.g., Image 3') and new Image 4. Rather than delaying the display of Image 4 until the display of Image 3' is completed, display of Image 3' is interrupted and Image 4 is displayed. In one embodiment, Image 4 is displayed by painting Image 4 starting at the top of the display. After Image 4 is displayed, Image 5 is output to the LCD panel when it is received by the variable refresh display device. As shown in FIG. 2A, the abort rescan operation reduces the delay to switch from displaying Image 3' to Image 4 significantly compared with conventional techniques shown in FIG. 1B.

Figure 2B:
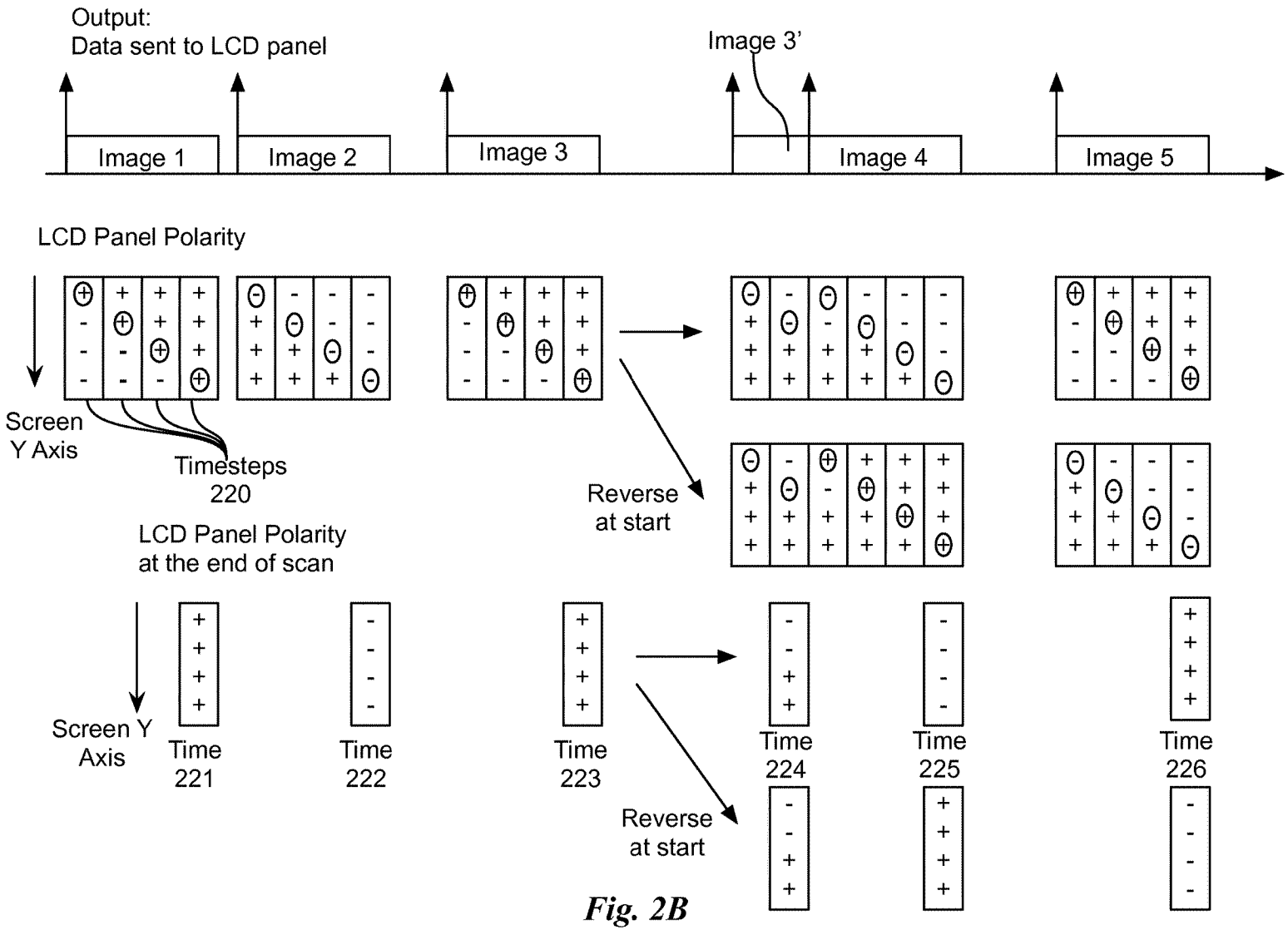
FIG. 2B illustrates the example FIG. 2A annotated with reversed polarity, in accordance with one embodiment.

FIG. 2B illustrates the example FIG. 2A annotated with reversed polarity, in accordance with one embodiment. Image 1 is fully painted (i.e., displayed) using a positive polarity (shown as +). The painting of Image 1 is shown over timesteps 220, where four timesteps 220 are needed to display the entire image. Each column shows the polarity of the LCD panel for one timestep. At the first timestep ¼ of Image 1 is displayed using positive polarity. The remaining ¾ lower portion of the LCD panel in the first timestep displays a previous image that was painted using a negative polarity (shown as −). At the second timestep ½ of Image 1 is displayed using positive polarity. At the third timestep ¾ of Image 1 is displayed using positive polarity. At the fourth timestep the entire Image 1 is displayed using positive polarity. After Image 1 is displayed, Image 2 is fully painted using a negative polarity. After Image 2 is displayed, Image 3 is fully painted using a positive polarity. The polarity is reversed (e.g., from positive to negative or from negative to positive) for each frame. In other words, each time a complete image is displayed, the polarity is reversed.

Because, Image 4 is not received soon enough to satisfy the minimum refresh frequency of the variable refresh display device, Image 3 is redisplayed (shown as Image 3') using negative polarity. Image 4 is received while Image 3 is being redisplayed—causing a temporal collision between the painting of Image 3' and new Image 4. Rather than delaying the display of Image 4 until the display of Image 3' is completed, display of Image 3' is interrupted and Image 4 is displayed using negative polarity starting at the top of the display. After Image 4 is displayed, Image 5 displayed using positive polarity.

In another embodiment, the polarity is reversed at the start of displaying each Image, even when the previous Image was not fully painted, as is the case for Image 3'. As shown in FIG. 2B following the arrow labeled "reverse at start," when display of Image 3' is interrupted, Image 4 is displayed using positive polarity starting at the top of the display. After Image 4 is displayed, Image 5 displayed using negative polarity.

As shown in FIG. 2B, when Image 1 is fully painted at time 221, the entire LCD panel has a positive polarity. When Image 2 is fully painted at time 222, the entire LCD panel has a negative polarity and when Image 3 is fully painted at time 223, the entire LCD panel has a positive polarity. When Image 3' is painted to the top half of the LCD panel at time 224, the top half has a negative polarity and the bottom half of the LCD panel has a positive polarity (i.e., the reverse or opposing polarity). After Image 4 is fully painted at time 225, the entire LCD panel has either a negative polarity or a positive polarity (for "reverse at start"). When Image 5 is fully painted at time 226, the entire LCD panel has either a positive polarity or a negative polarity (for the alternate).

The top half of the LCD panel displays the Images using an alternating +/−/+/− polarity pattern until Image 4 is painted to the top half when the pattern does not alternate and instead the negative polarity is used twice. The bottom half of the LCD panel displays the Images using an alternating +/−/+ polarity pattern until Image 3' is painted only to the top half when the pattern does not alternate and instead the positive polarity is used twice. The complete patterns for the top and bottom halves are +/−/+/−/−/+ and +/−/+/+/−/+, respectively. Similarly, when the "reverse at start" scheme is used to perform DC balancing, the complete patterns for the top and bottom halves are +/−/+/−/+/− and +/−/+/+/+/−, respectively. The residual charge between the top half and the bottom half of the LCD panel will be very different and the known, frame-based polarity switching, techniques to correct this DC imbalance are not effective.

Instead of choosing the polarity only once for each frame or the start of painting an image, the LCD panel may be configured to control the polarity for individual regions. In addition to the spatial polarity pattern, a temporal polarity pattern or polarity inversion mask may be defined for each region that controls whether or not the polarity of the spatial polarity pattern is reversed or not each time the region is painted. In one embodiment, the polarity inversion mask for a region is a sequence of values for a single bit. The temporal polarity pattern for a particular region may be based on DC balance characteristics of the particular region. The DC balance characteristics may indicate the amount (i.e., duration) of time (as an absolute value, relative value, or ratio) that the region has been displayed using a positive polarity and/or a negative polarity.

In one embodiment, the number of regions for which the polarity can be controlled matches the granularity by which painting of an image to the display can be interrupted. For example, if the LCD panel can perform an abort-rescan operation for each visible line, the polarity can be controlled for each visible line. In another embodiment, the number of regions for which the polarity can be controlled is greater than the granularity by which an on-going scan can be interrupted. In yet another embodiment, the polarity can be controlled for each pixel of the variable refresh display device.

Figure 2C:
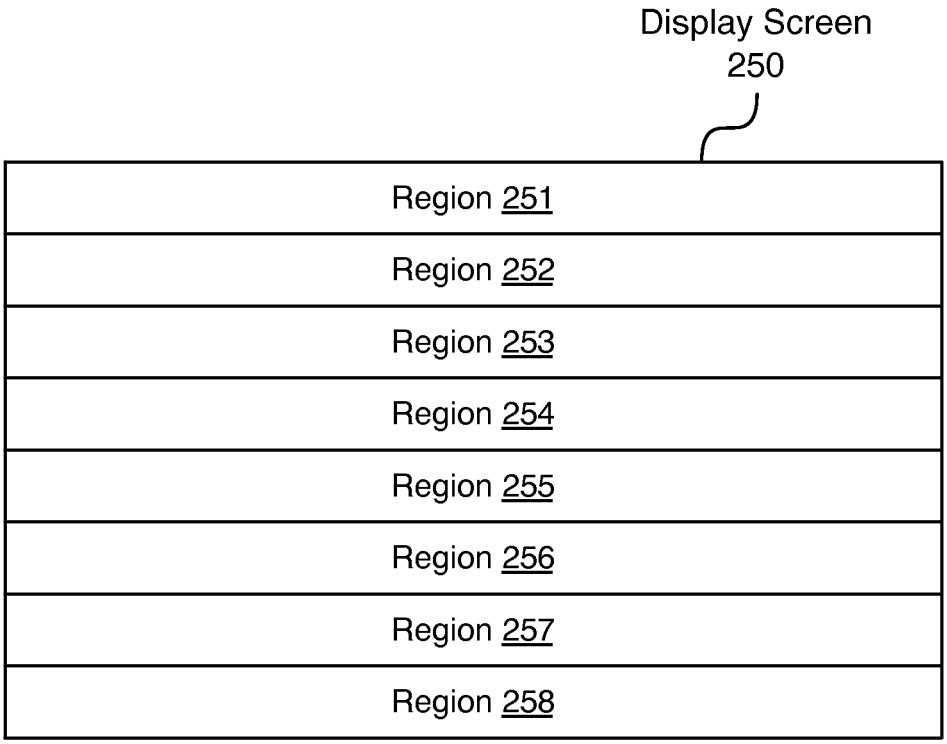
FIG. 2C illustrates an example a display screen of a display device that is divided into multiple regions, in accordance with one embodiment.

FIG. 2C illustrates an example a display screen 250 of a variable refresh rate capable display device that is divided into multiple regions, in accordance with one embodiment. Eight different regions (regions 251, 252, 253, 254, 255, 256, 257, and 258) define the boundaries for which painting of an image to the display can be interrupted. In other embodiments, fewer or more regions may be defined for the display screen 250. The polarity may be separately controlled for each of the different regions. Although the regions are shown in FIG. 2C as being of equal size, in one embodiment, each of the regions may be smaller or larger in height than another one of the regions. Furthermore, in one embodiment each of the regions may be divided into two or more regions vertically.

FIG. 2D illustrates an example fixed polarity spatial inversion pattern 260, in accordance with the prior art. The fixed polarity spatial inversion pattern 260 may be inverted for alternating frames to produce the inverted fixed polarity spatial inversion pattern 265. When the frame rate is constant, DC balance will be maintained for each pixel of a display screen.

Figure 2E:
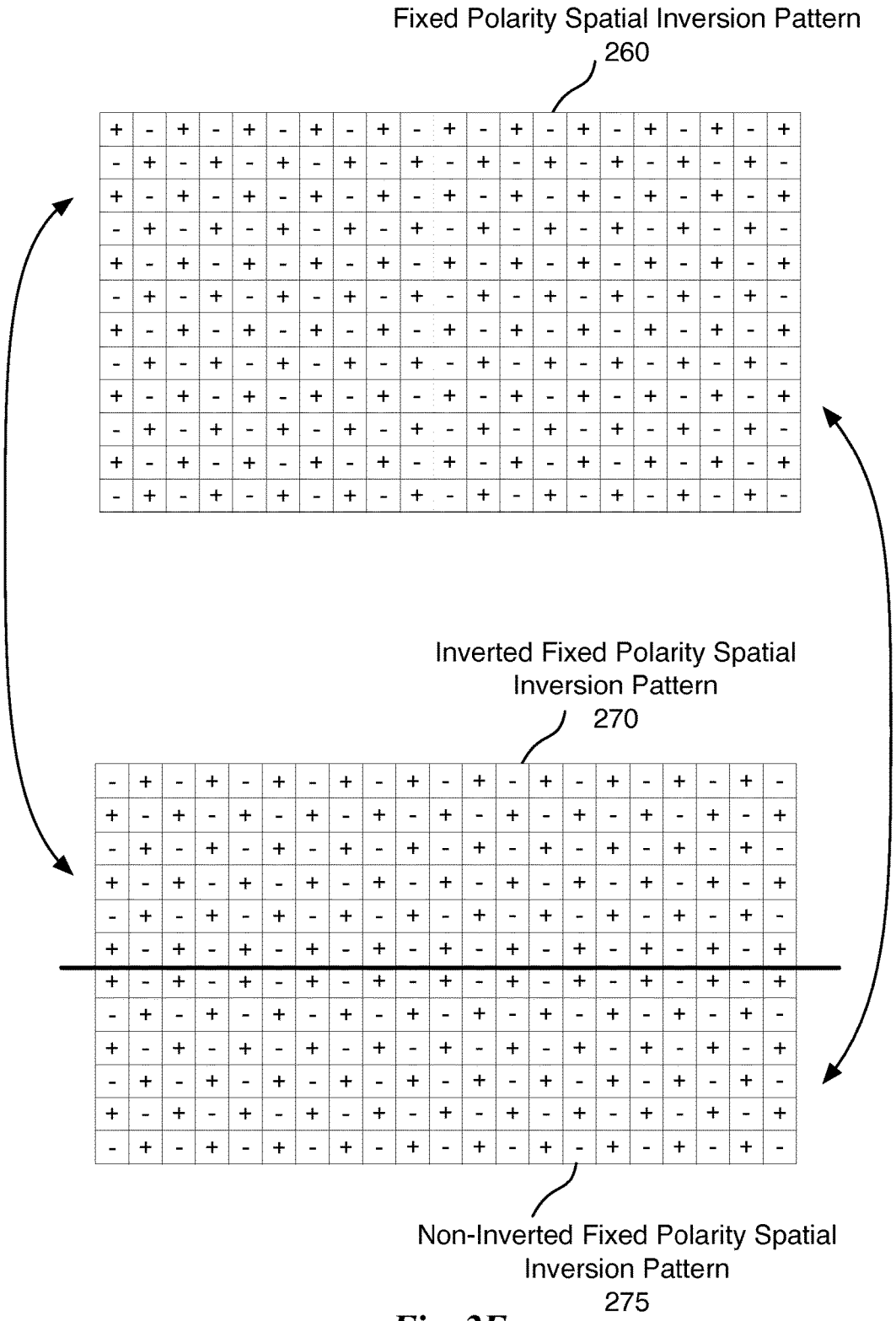
FIG. 2E illustrates an example polarity spatial inversion pattern that is independently inverted for one or more regions, in accordance with one embodiment.

FIG. 2E illustrates the example fixed polarity spatial inversion pattern 260 that is independently inverted for one or more regions, in accordance with one embodiment. The fixed polarity spatial inversion pattern 260 is inverted for a top region of a display screen to produce the inverted fixed polarity spatial inversion pattern 270 for the top region. The fixed polarity spatial inversion pattern 260 is not inverted for a bottom region of the display screen to produce the non-inverted fixed polarity spatial inversion pattern 275 for the bottom region. For a single frame, polarity of the top region may be inverted while polarity of the bottom region is not inverted. DC balance may be independently maintained for each region of the display screen. In one embodiment, a polarity inversion mask is determined that controls whether polarity for each region of the display screen is inverted. In one embodiment, the polarity inversion mask (i.e., temporal polarity pattern) includes one bit for each region of the display screen and the bit is Exclusive ORed (XORed) with the fixed polarity spatial inversion pattern 260 to invert or not invert the polarity of each pixel or each component. As shown in FIG. 2E, a first bit in the polarity inversion mask corresponding to the top region is set to TRUE and a second bit in the polarity inversion mask corresponding to the bottom region is set to FALSE. In another embodiment, a separate polarity inversion mask is determined for each region of the display screen.

Figure 3A:
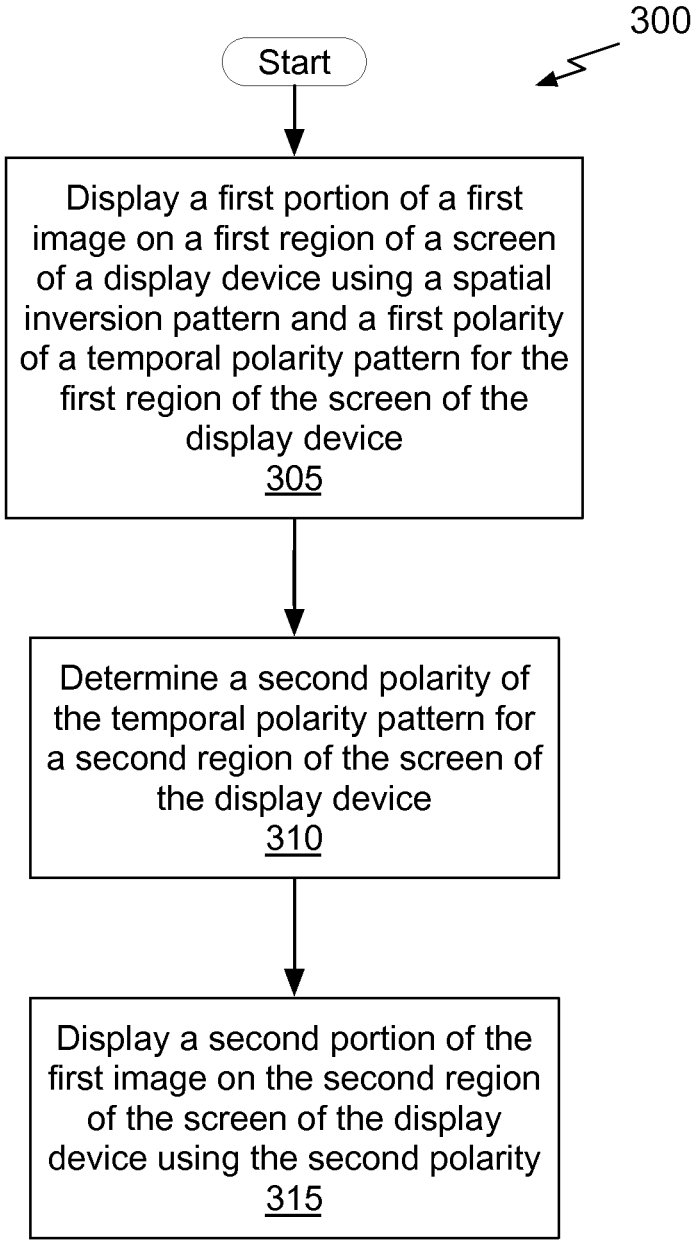
FIG. 3A illustrates a flowchart of a method for performing regional DC balancing for a dynamic refresh frequency capable display device, in accordance with one embodiment.

FIG. 3A illustrates a flowchart 300 of a method for performing regional DC balancing for a dynamic refresh frequency capable display device, in accordance with one embodiment. At step 305, a first portion of a first image is displayed on a first region of a screen of a display device using a spatial inversion pattern and a first polarity of a temporal polarity pattern for the first region of the screen of the display device. In the context of the following description, the first image, and subsequent images, may be generated by a GPU that is configured to render a two or three-dimensional scene to produce an image for display. The first image is a complete image intended to fill the display screen of a display device and the first image may be read from a frame buffer. In most variable refresh rate display devices, the arrival time of each new image will be unknown as the rendering rate of the images will vary based on the complexity of the scene being rendered.

At step 310, a second polarity of a second temporal polarity pattern for a second region of the screen of the display device is determined. The first temporal polarity pattern and the second temporal polarity pattern may be different or the same. In one embodiment, the temporal polarity pattern for each region of the screen of the display device is determined based on a DC balance characteristic for the particular region.

At step 315, a second portion of the first image is displayed on the second region of the screen of the display device using the spatial inversion pattern and the second polarity of the second temporal polarity pattern. Rather than reversing the polarity between frames or at the start of painting an image, in one embodiment, the polarity is reversed at the boundary where painting was last interrupted. Importantly, whether the spatial inversion polarity is reversed may be controlled for each region of the screen so that the polarity may be reversed within a frame and within an image. Furthermore, in another embodiment, the polarity is reversed at a region as needed to best maintain a DC balance for the particular region.

In most variable refresh rate displays, the arrival time of each new frame of image data is unknown, and a heuristic based on past events may be used to estimate the arrival time of the next frame of image data. The estimated arrival time may be utilized to find a number of times the previous frame of image data should be refreshed on the display device in order to ensure that the display device is operating within specifications provided by the display device as to a minimum and maximum refresh frequency of the display device. The estimated arrival time is a next image duration representing the time required to render the next image data (e.g., second image) into a frame buffer and, consequently, the time that the current image data (first image) will be displayed by the display device while waiting for the next image data to be received. Importantly, as previously explained, the frame duration is independent of the image duration. The frame duration corresponds to the frame rate, and the frame rate is defined as the rate at which the display is refreshed with the image data than may, or may not, have changed.

In one embodiment, the refresh timeout may be computed based on the estimated next image duration and/or the image duration of one or more previous images. For example, the refresh timeout may be computed so that repeated frames are spaced equidistantly between each new image. In one embodiment, a timing controller in the display device calculates an estimate for the next image duration and/or the refresh timeout. In another embodiment, a scaling unit in the display device calculates an estimate for the next image duration and/or the refresh timeout. In yet another embodiment, a processor external to the display device, such as a graphics processing unit, calculates an estimate for the next image duration and/or the refresh timeout.

More illustrative information will now be set forth regarding various optional architectures and features with which the foregoing framework may or may not be implemented, per the desires of the user. It should be strongly noted that the following information is set forth for illustrative purposes and should not be construed as limiting in any manner. Any of the following features may be optionally incorporated with or without the exclusion of other features described.

Figure 3B:
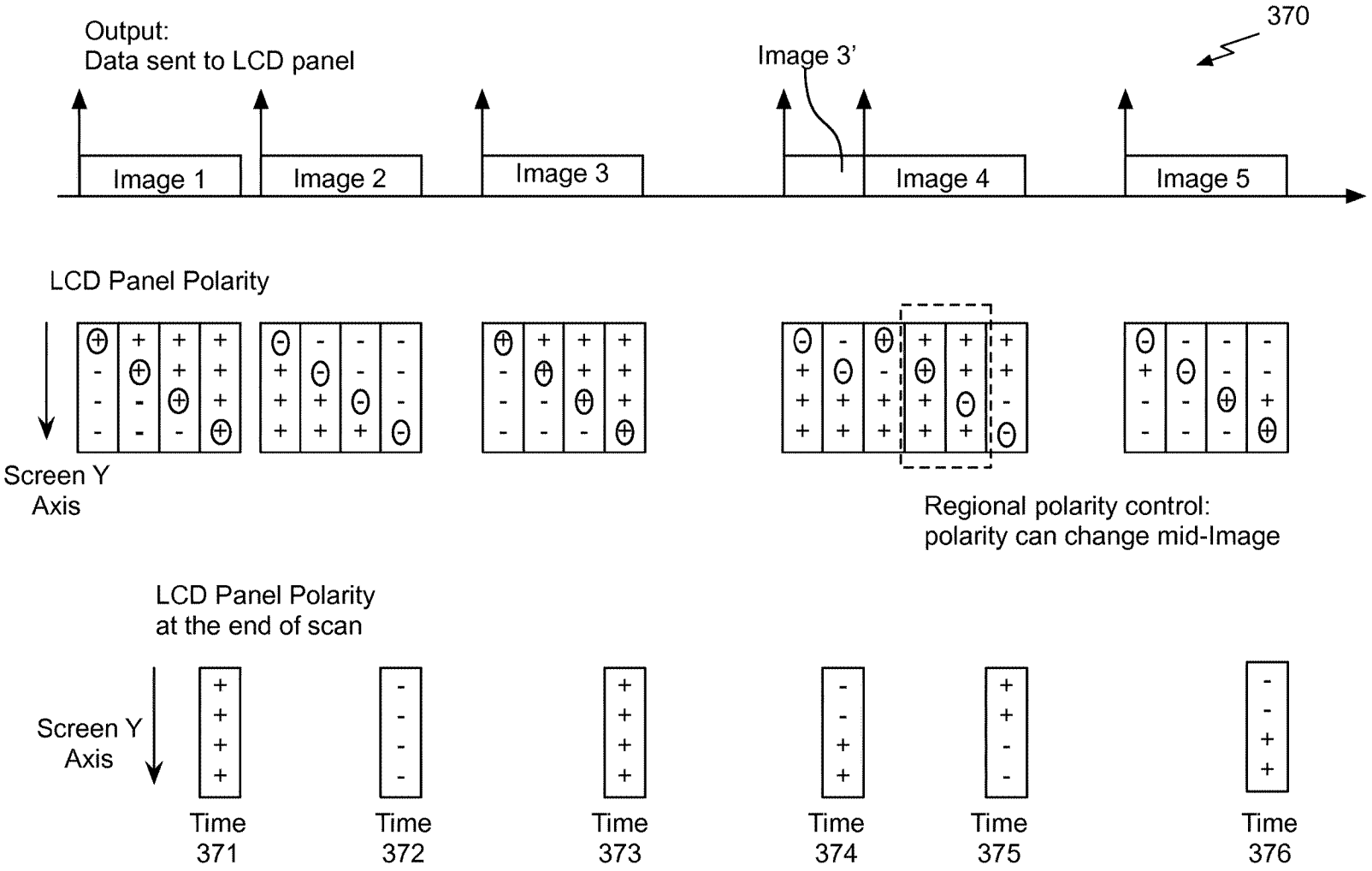
FIG. 3B illustrates the example FIG. 2A annotated with per-region polarity, in accordance with one embodiment.

FIG. 3B illustrates the example FIG. 2A annotated with per-region polarity 370, in accordance with one embodiment. Image 1 is fully painted (i.e., displayed) using a positive polarity (shown as +). The painting of Image 1 is shown over timesteps, where four timesteps are needed to display the entire image. Two of the eight regions defined for the display screen 250 shown in FIG. 2C are painted during each timestep. In other embodiments, one timestep may correspond to each region. Each column shows the polarity of the LCD panel for one timestep. At the first timestep ¼ of Image 1 is displayed for regions 251 and 252 using positive polarity. The remaining ¾ lower portion of the LCD panel in the first timestep displays a previous image that was painted using a negative polarity (shown as −). During the second timestep, the regions 253 and 254 are painted with Image 1, so that ½ of Image 1 is displayed using positive polarity at the end of the second timestep. During the third timestep, the regions 255 and 256 are painted with Image 1, so that ¾ of Image 1 is displayed using positive polarity at the end of the third timestep. During the fourth timestep, the regions 257 and 258 are painted with Image 1, so that the entire Image 1 is displayed using positive polarity at the end of the fourth timestep at time 371. After Image 1 is displayed, Image 2 is fully painted using a negative polarity. After Image 2 is displayed, Image 3 is fully painted using a positive polarity. The polarity is reversed (e.g., from positive to negative or from negative to positive) for each frame. In other words, each time a complete image is displayed, the polarity of the voltage used to display the next image is reversed. The temporal polarity pattern controls reversing of the polarity specified by the spatial inversion pattern of the display screen.

Because, Image 4 is not received soon enough to satisfy the minimum refresh frequency of the variable refresh display device, Image 3 is redisplayed (shown as Image 3') using negative polarity. Image 4 is received while Image 3 is being redisplayed—causing a temporal collision between the painting of Image 3' and new Image 4. Rather than delaying the display of Image 4 until the display of Image 3' is completed, display of Image 3' is interrupted, and the polarity is reversed, according to the temporal polarity pattern, before painting of Image 4 begins. The "next region" to be painted with Image 3' is stored (e.g., region 255) and when the "next region" is reached during painting of Image 4, the polarity will be reversed again, according to the temporal polarity pattern, to perform DC balancing. In one embodiment, the "next region" may be initialized as the region at the top of the display device (e.g., region 251). In one embodiment, the last region that was painted may be indicated instead of the "next region" (e.g., region 254) and after the "last region" is reached during painting, the polarity is reversed, according to the temporal polarity pattern. The "next region" or the "last region" is state data indicating a location of a polarity reversal boundary between two adjacent regions or at the top or bottom region. In one embodiment, one bit of a temporal polarity pattern is stored for each region and each time the region is painted, the bit is toggled. When the region is painted, the bit is XORed with the fixed polarity spatial inversion pattern to reverse the polarity each time the region is painted to perform DC balancing.

At time 374, after the region 255 is painted with the Image 3', the polarity of regions 251, 252, 253, and 254 is negative and the polarity of regions 255, 256, 257, and 258 is positive. Image 4 is displayed using positive polarity starting at the top of the display. After region 254 is painted, the "next region" is reached and the polarity is reversed, according to the temporal polarity pattern, to begin painting the region 255 with the Image 4. The "next region" remains unchanged until painting of an image is interrupted when a new image is received. After Image 4 is displayed, painting of Image 5 begins at region 251 using negative polarity. After region 254 is painted with Image 5, the "next region" is reached and the polarity is reversed, according to the temporal polarity pattern, from negative to positive to begin painting the region 255 with the Image 5.

As shown in FIG. 3B, when Image 1 is fully painted at time 371, the entire LCD panel has a positive polarity. When Image 2 is fully painted at time 372, the entire LCD panel has a negative polarity and when Image 3 is fully painted at time 373, the entire LCD panel has a positive polarity. When Image 3' is painted to the top half of the LCD panel at time 374, the top half has a negative polarity and the bottom half of the LCD panel has a positive polarity (i.e., the reverse or opposing polarity). After Image 4 is fully painted at time 375 the top half of the LCD panel has a positive polarity and the bottom half of the LCD panel has a negative polarity (i.e., the reverse or opposing polarity). The polarity is changed within the Image 4. When Image 5 is fully painted at time 376, the top half of the LCD panel has a negative polarity and the bottom half of the LCD panel has a positive polarity (i.e., the reverse or opposing polarity). Importantly, each time a region is painted, the polarity is reversed.

Regions 251, 252, 253, and 254 in the top half of the LCD panel display the Images using an alternating +/−/+/−/+/− polarity pattern. The temporal polarity pattern for the regions 251, 252, 253, and 254 is an alternating pattern of TRUE, FALSE, TRUE, FALSE, TRUE, FALSE or FALSE, TRUE, FALSE, TRUE, FALSE, TRUE. Regions 255, 256, 257, and 258 in the bottom half of the LCD panel display the Images using an alternating +/−/+/−/+ polarity pattern. The temporal polarity pattern for the regions 255, 256, 257, and 258 is also an alternating pattern of TRUE, FALSE, TRUE, FALSE, TRUE or FALSE, TRUE, FALSE, TRUE, FALSE. Note that the bottom half of the LCD is not updated after time 373 until time 375. The polarity is controlled for each of the regions and a "next region" is maintained to enable improved DC balancing. The "next region" value may be a binary identifier that is stored in a register or other memory.

Figure 3C:
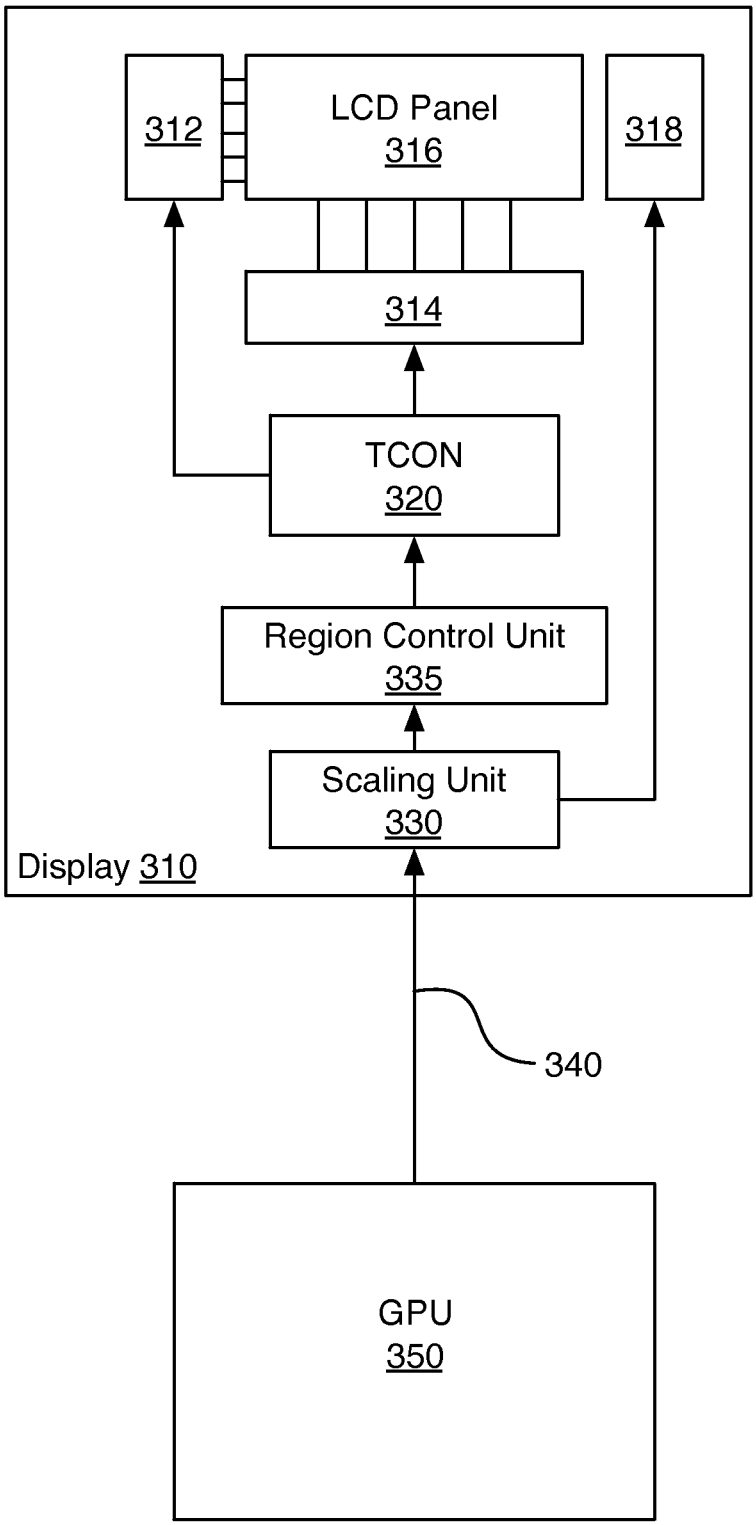
FIG. 3C illustrates a system that includes a dynamic refresh frequency capable display, in accordance with one embodiment.

FIG. 3C illustrates a system that includes a dynamic refresh frequency capable display 310, in accordance with one embodiment. A GPU 350 may render frames of image data based on 3D primitives defined by an application executing on a CPU (not explicitly shown). The frames of image data may include pixel data stored in a frame buffer, which is a portion of memory allocated to store pixel data that is utilized to generate a video signal transmitted over a video interface 340. In one embodiment, the GPU 350 may be associated with a dual frame buffer (or ping-pong buffer) that includes a first portion of the frame buffer that stores pixel data for a previously rendered frame that is read out of memory and encoded within the video signal transmitted via the video interface 340 and a second portion of the frame buffer that stores pixel data for the current frame being rendered by the GPU 350. Once the GPU 350 has completed rendering of the current frame, the roles of the first portion of the frame buffer and the second portion of the frame buffer may be switched such that the second portion of the frame buffer stores pixel data for the recently rendered frame that is read out of memory and encoded within the video signal transmitted via the video interface 340 and the first portion of the frame buffer stores pixel data for the next frame being rendered by the GPU 350. The roles of the first and second portion of the frame buffer may alternate after each frame is rendered.

In one embodiment, the display 310 includes an LCD panel 316 that includes a plurality of pixel elements, each pixel element comprising a plurality of liquid crystal elements corresponding to a plurality of color components (e.g., a red component, a green component, and a blue component). In one embodiment, the display screen 250 is divided into multiple regions is the LCD panel 316. The display 310 may also include row drivers 312 and column drivers 314 for controlling each of the pixel elements in the LCD panel 316. The row drivers 312 and column drivers 314 enable each individual pixel element in the LCD panel 316 to be addressed and each liquid crystal element of the pixel element to have a voltage applied thereto in order to vary a level of the corresponding color component displayed by the pixel element.

The display 310 also includes a backlight 318, which may comprise one or more compact fluorescent lights (CFLs) arranged around the edge or edges of the LCD panel 316, one or more LEDs arranged around the edge or edges of the LCD panel 316, or an array of LEDs arranged behind the pixel elements of the LCD panel 316. It will be appreciated that, in some embodiments, the display 310 may be an OLED panel or AMOLED panel that does not include the backlight 318.

The display 310 may also include a region control unit 335, a timing controller (TCON) 320, and a scaling unit 330. The TCON 320 controls the row drivers 312 and the column drivers 314 in order to display the frames of image data on the LCD panel 316. The polarity of the voltage is controlled by the region control unit 335 to maintain DC balance for the LCD panel 316. The region control unit 335 is configured to initialize and update a "next region" state value and control the voltage polarity that is used during scanout (i.e., painting or displaying) of an image to each region. The region control unit 335 outputs one or more signals to control the voltage polarity for each region. In one embodiment, the region control unit 335 controls the polarity of each region to ensure that each time a particular region is painted, the polarity is reversed.

The scaling unit 330 receives the video signal from a GPU 350 via the video interface 340. The video signal may correspond to a particular video signal format, such as a digital video signal format or an analog video signal format. Exemplary digital video signal formats include DVI (Digital Visual Interface), HDMI (High-Definition Multimedia Interface), and the like. Exemplary analog video signal formats include NTSC (National Television System Committee), PAL (Phase Alternating Line), VGA (Video Graphics Array), and the like.

The particular image data received via the video interface 340 may have a resolution that does not match a native resolution of the LCD panel 316. Thus, the scaling unit 330 is configured to scale the image frames encoded within the video signal to match the native resolution of the LCD panel 316. The scaling unit 330 may be configured to scale the images in the horizontal direction and/or the vertical direction. In one embodiment, the scaling unit 330 may filter the images. In yet another embodiment, where display 310 comprises a direct drive monitor or an LCD panel 316 included in a laptop computer, display 310 may not include a scaling unit 330.

The scaling unit 330 may also control the backlight 318. For example, the scaling unit 330 may determine a particular level of illumination the backlight 318 should provide for a given frame of image data and control the backlight 318 to provide the particular level of illumination. In an alternate embodiment, the display 310 may include a separate circuit that controls the backlight 318 such that the scaling unit 330 does not control the backlight 318.

Figure 4A:
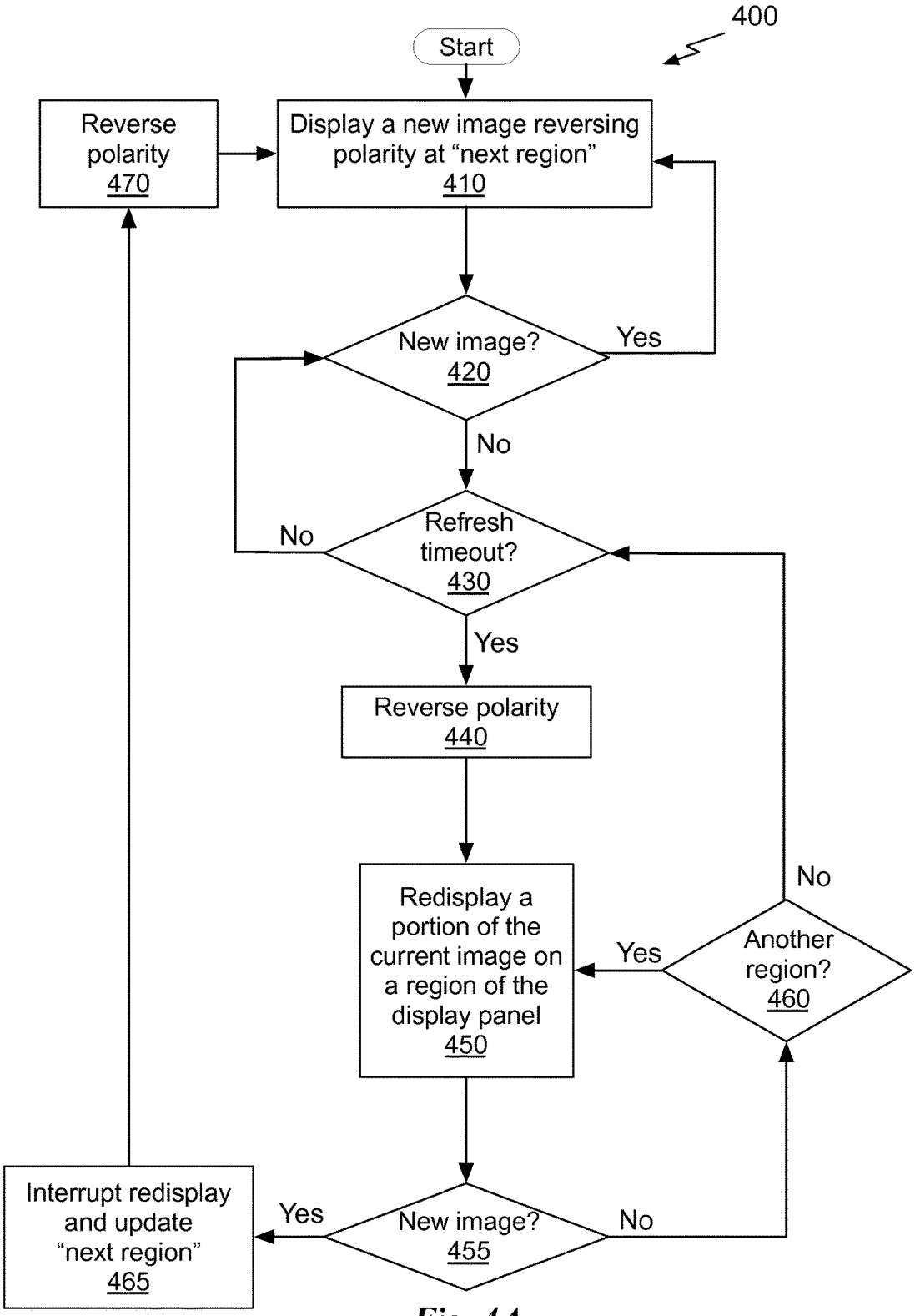
FIG. 4A illustrates another flowchart of a method for performing regional DC balancing for a dynamic refresh frequency capable display device, in accordance with one embodiment.

FIG. 4A illustrates another flowchart 400 of a method for performing regional DC balancing for a dynamic refresh frequency capable display device, in accordance with one embodiment. The "next region" may be initialized by the region control unit 335 as the region 251. In one embodiment, the "next region" that is used for initialization may be programmed as any of the regions of the display screen 250. The method shown in FIG. 4A may be implemented to produce the example 370 shown in FIG. 3B. At step 410 a new image is displayed and when the "next region" is reached, the polarity is reversed. At step 420, the display 310 determines if a new image is received from the GPU 350, and, if so, the method returns to step 410 to display the new image. Otherwise, if a new image is not received, then at step 430, the display 310 determines if a refresh timeout has occurred. If a refresh timeout has not occurred, then the method returns to step 420. Otherwise, if a refresh timeout has occurred, then at step 440, the polarity control unit 335 within the display 310 reverses the polarity of the voltage used to display the image data in preparation for redisplaying the current image. In one embodiment, reversal (or not) of the polarity for each region may be controlled by the temporal polarity pattern. A spatial inversion pattern for the display device may be reversed or not for each region according to the temporal polarity pattern.

At step 450, the display 310 redisplays a portion of the current image in a region of the display panel. At step 455, the display 310 determines if a new image is received from the GPU 350, and, if so, at step 465, the redisplay is interrupted and the "next region" is updated by the region control unit 335. The "next region" is updated to specify the next region to be painted to redisplay the current image. At step 470, the region control unit 335 reverses the polarity of the voltage used to display the image data in preparation for displaying the new image and then returns to step 410 to display the new image. If, at step 455, the display 310 determines a new image has not been received from the GPU 350, then at step 460, the display 310 determines if another portion of the current image should be redisplayed for another region (i.e., if the redisplaying is not done). If the redisplaying is not done, then the method returns to step 450. Otherwise, the method returns to step 430 where the display 310 determines if a refresh timeout has occurred.

A major cause of DC imbalance in a variable refresh display panel that supports the abort-rescan operation is that regions are always updated in a linear, top-down order. For example, upon the start of a redisplay and also upon the start of displaying a new image (following an interrupted redisplay), painting of an image always starts at the topmost region (e.g., region 251). As a result, the topmost region is refreshed more often than regions closer to the bottom when the abort-rescan operation is supported, and there will be a gradual change in DC imbalance between regions near top of the display screen 250 and regions near the bottom of the display screen 250.

One solution to avoid DC imbalance caused by the abort-rescan operation is to start painting the display screen 250 at a different region whenever an image is redisplayed. For example, a redisplay of a first image starts at the region 251 and a redisplay of a second image (or a second redisplay of the first image) starts at the region 255 (or any region other than region 251). A different region is used to start a redisplay until a redisplay has started at each region. Then the same sequence of regions to start redisplays may be used again, or a different sequence may be used. When the starting region is varied for redisplaying images, the DC imbalance may be spread more evenly across the display screen 250 and approximately equalized between the different regions. Equalization of the DC imbalance across the regions enables the application of full-frame DC imbalance techniques in addition to region-based DC imbalance prevention.

Figure 4B:
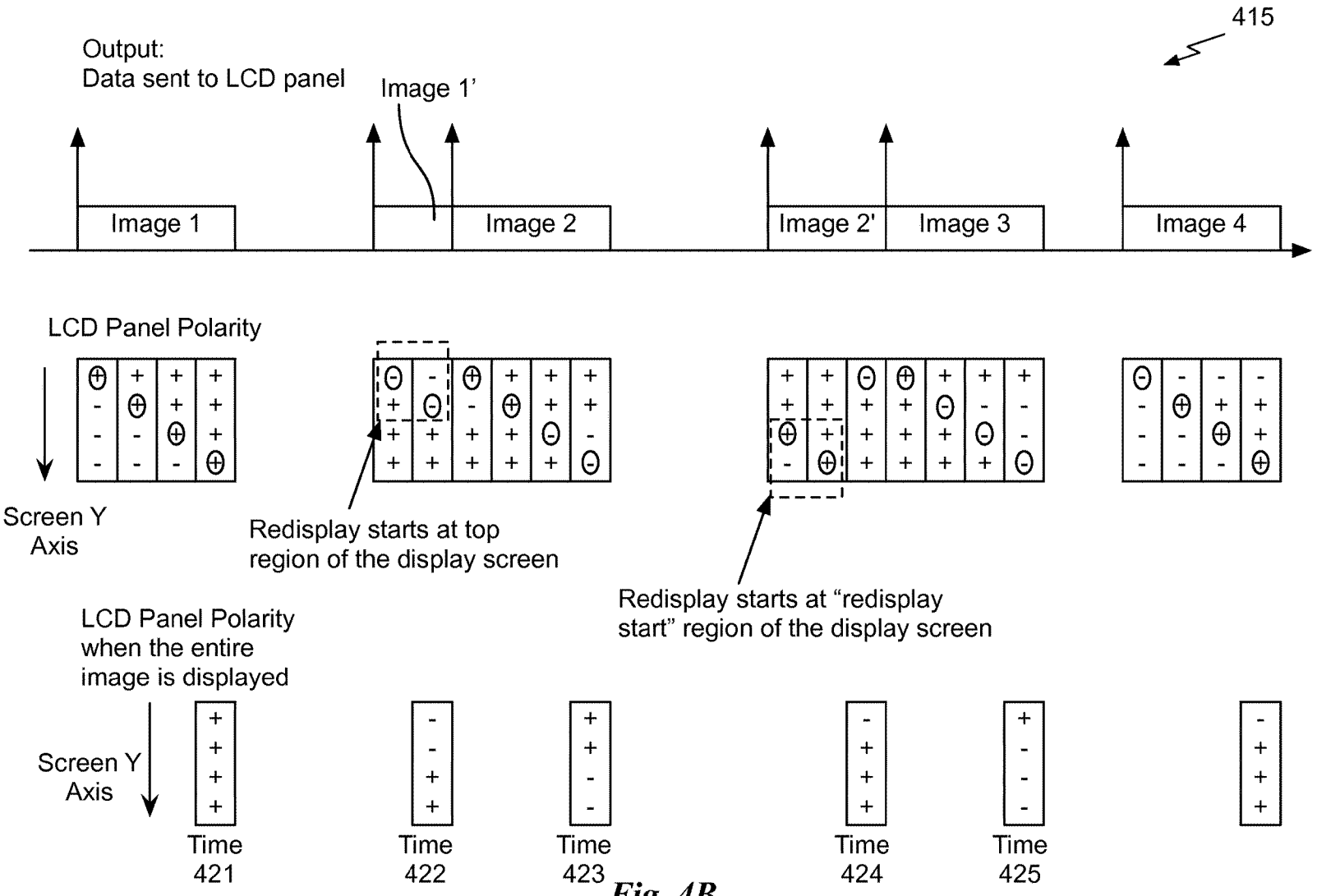
FIG. 4B illustrates an example of interrupted image repetition on a variable refresh display device annotated with reversed polarity, in accordance with one embodiment.

FIG. 4B illustrates an example 415 of interrupted image repetition on a variable refresh display device annotated with reversed polarity, in accordance with one embodiment. Image 1 is fully painted (i.e., displayed) using a positive polarity (shown as +). The painting of Image 1 is shown over timesteps, where four timesteps are needed to display the entire image. Two of the eight regions defined for the display screen 250 shown in FIG. 2C are painted during each timestep. The entire Image 1 is displayed using positive polarity at the end of the fourth timestep at time 421.

Because, Image 2 is not received soon enough to satisfy the minimum refresh frequency of the variable refresh display device, redisplay of Image 1 (shown as Image1') starts at the topmost region (e.g., region 251) using negative polarity. Image 2 is received while Image 1 is being redisplayed. The redisplay of Image 1 is interrupted after a portion of the Image 1 is redisplayed for region 254, and the polarity is reversed before painting of new Image 2 begins at the topmost region. The region control unit 335 may be configured to store a "redisplay start" value that is used to control the region at which each redisplay operation starts. In one embodiment, the "redisplay start" may be a counter that equals the number of different regions and increments to start at each region in succession from the top to the bottom of the display screen 250. As shown in FIG. 4B, the redisplay of Image 2 starts at the region 255. In another example, based on a "redisplay start" count, the redisplay of image 2 may start at a different region instead of the region 255. In one embodiment, the "redisplay start" value is updated each time a scan-abort operation is performed. When the redisplay of Image 1 is interrupted, the "next region" to have been painted with Image 1' is updated to region 255.

Image 2 is painted using a positive polarity until the "next region" is reached and then the polarity is reversed. The remainder of Image 2 is painted using a negative polarity. Because, Image 3 is not received soon enough to satisfy the minimum refresh frequency of the variable refresh display device, the polarity is reversed, and then redisplay of Image 2 (shown as Image 2') starts at the "redisplay start" region (e.g., region 255) using positive polarity. The "redisplay start" may be a counter that is incremented to determine the region at which redisplay starts for Image 2. In one embodiment, the "redisplay start" is updated for each redisplay to ensure that each region is used as the start for redisplaying an image before any region is used as the start again.

After the Image 2' is displayed for the last region of the display screen 250, the polarity is reversed and display of the Image 2' resumes at the top of the display screen 250 using a negative polarity. Image 3 is received while Image 2 is being redisplayed. The redisplay of Image 2 is interrupted after a portion of the Image 2 is redisplayed for region 252, and the polarity is reversed before painting of new Image 3 begins at the topmost region, region 251, using a positive polarity. When the redisplay of Image 2 is interrupted, the "next region" to have been painted with Image 2' is updated to region 253. When the "next region" is reached during painting of Image 3, the polarity is reversed to perform DC balancing. The remainder of Image 3 is painted using a negative polarity. Image 4 is received and is drawn starting at the topmost region using a negative polarity because the region 251 was last painted (with Image 3) using a positive polarity. Importantly, the polarity used to paint each region is stored as state data to ensure that DC balance is maintained. The region control unit 335 may be configured to store the state data for each region. When the "next region" is reached during painting of Image 4 (e.g., region 253), the polarity is reversed to perform DC balancing. The remainder of Image 4 is painted using a positive polarity.

At time 422, after the region 254 is painted with the Image 1', the polarity of regions 251, 252, 253, and 254 is negative and the polarity of regions 255, 256, 257, and 258 is positive. Image 2 is displayed using positive polarity starting at the top of the display. After region 254 is painted, the "next region" is reached and the polarity is reversed to continue painting the region 255 with the Image 2. The "next region" remains unchanged until painting of an image is interrupted when a new image is received. After Image 2 is displayed at time 423, redisplay of Image 2 begins at region 255 using positive polarity. After region 258 is painted with Image 2', the polarity is reversed from negative to positive to continue painting the region 251 with the Image 2'.

As shown in FIG. 4B, each time a region is painted, the polarity is reversed. Regions 251 and 252 in the top quarter of the display screen 250 display the Images using an alternating +/−/+/−/+/− polarity pattern. Regions 253 and 254 in the second quarter of display screen 250 display the Images using an alternating +/−/+/−/+ polarity pattern. Note that regions 253 and 254 are not updated after time 423 until time 425. Regions 255 and 256 in the third quarter of display screen 250 display the Images using an alternating +/−/+/−/+ polarity pattern. Regions 257 and 258 in the bottom quarter of display screen 250 display the Images using an alternating +/−/+/−/+ polarity pattern. Note that regions 255, 256, 257, and 258 are not updated after time 421 until time 423. The polarity is controlled for each of the regions and a "next region" value and "start redisplay" value may be maintained to enable improved DC balancing.

In addition to having a display screen 250 for which the polarity for each region can be controlled, the display 310 should also be configured to control the polarity per region in such a way that the DC imbalance is kept to a minimum. In one embodiment, the display screen 250 is continuously refreshed at the highest possible refresh rate even if the render rate of the GPU 350 (i.e. rate at which the GPU 350 generates new images) is much lower, since temporal collisions either do not occur or the impact of temporal collisions on stutter is reduced enough to be of no concern due to the abort-rescan. When the display screen 250 is continuously refreshed at the highest possible refresh rate, it may be sufficient to ensure that the polarity of each region is always reversed for successive refreshes. In one embodiment, a single flip-flop per region may be used to store the polarity of the last refresh. The value stored in the flip-flop may be used to control the polarity for the region when it is toggled to reverse the polarity for each refresh. In one embodiment, the amount of time (i.e. duration) for which each region displays an image using a negative polarity may be tracked and the amount of time for which each region displays an image using positive polarity may be tracked. The amounts of time may be used to determine an average DC imbalance for each region. In one embodiment, the average DC imbalance for a region is a DC balance characteristic that is used to determine the temporal polarity pattern for a region. The average DC imbalance for a region may be used to control the "start redisplay" value or to selectively delay the display of an image to improve the DC balance for one or more regions. When a display 310 supports non-linear order scanning, the regions may be refreshed in any particular order (i.e., not necessarily top to bottom) to reduce or prevent DC imbalance.

Figure 4C:
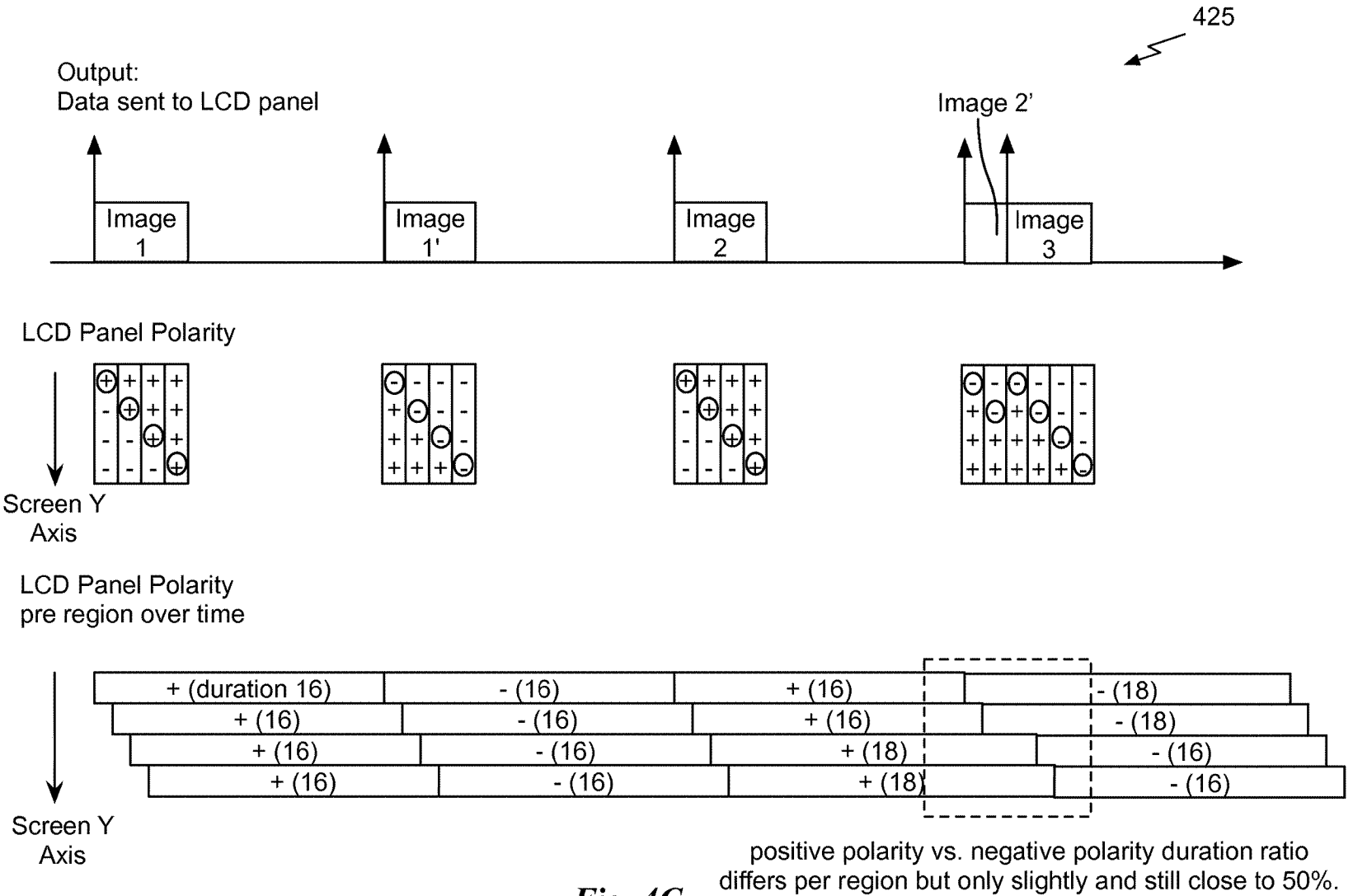
FIG. 4C illustrates an example of interrupted image repetition on a variable refresh display device annotated with reversed polarity reuse, in accordance with one embodiment.

FIG. 4C illustrates an example 425 of interrupted image repetition on a variable refresh display device annotated with reversed polarity reuse, in accordance with one embodiment. For a display 310 with a high ratio between maximum and minimum frame rate, a polarity control technique, is to reuse the same starting polarity to display a new image as was used to redisplay a current image that is interrupted by the new image. Because the idle time during which the display screen 250 is not being painted with an image is significantly larger than the active time during which the display screen 250 is being painted, the ratio between positive polarity and negative polarity durations is not significantly influenced by reusing the same polarity to display a new image as was used to display the interrupted image.

As shown in FIG. 4C, the polarity used to display Image 3 is the same as was used to display the interrupted display of Image 2'. Instead of a 50% duty cycle between positive polarity and negative polarity (duration of 16 for both positive polarity and negative polarity), the ratio is changed to 47% or 53% when the same polarity is used to display new images as was used to display a redisplayed image that is interrupted by the new image.

Figure 5:
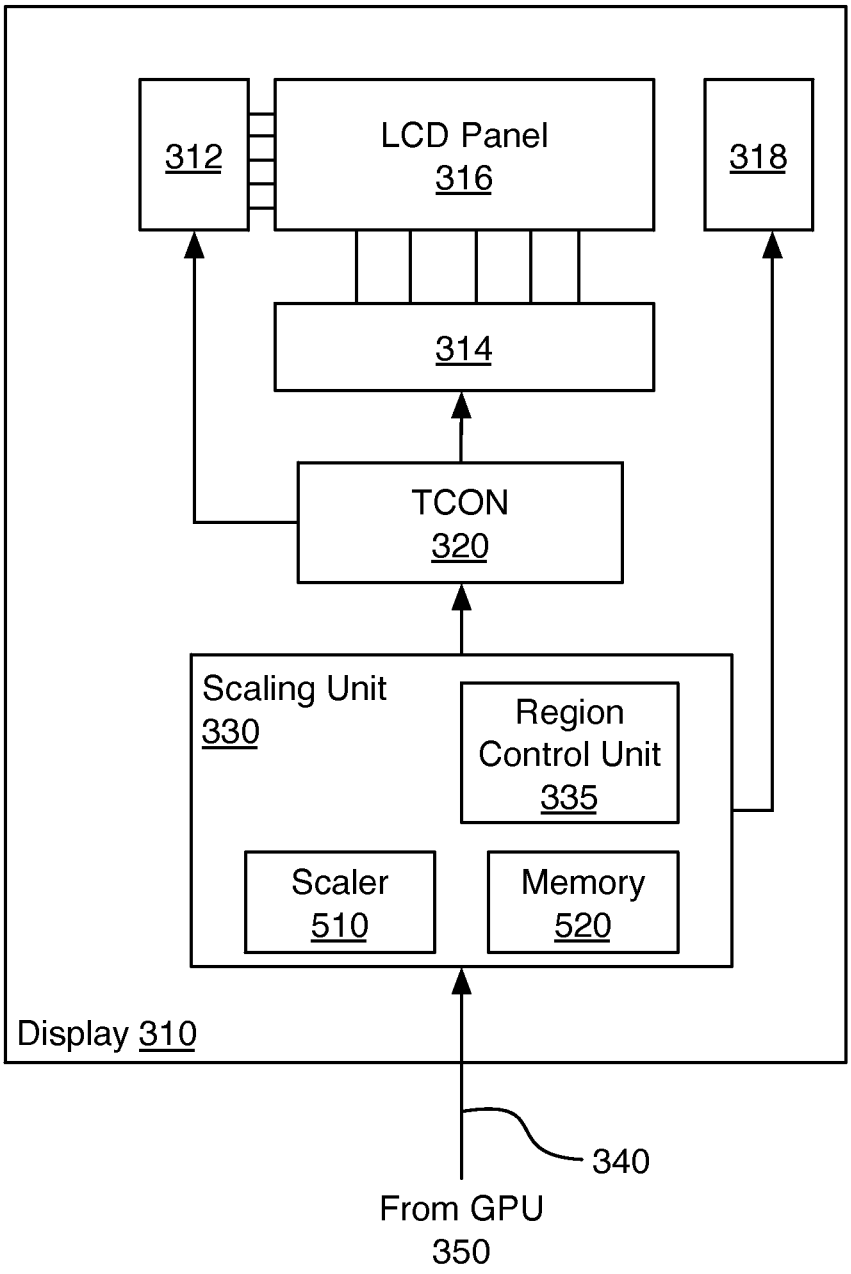
FIG. 5 illustrates the operation of the scaling unit of FIG. 3C, in accordance with another embodiment.

FIG. 5 illustrates the operation of the scaling unit 330 of FIG. 3C, in accordance with another embodiment. In another embodiment, the logic for ensuring that the display device refreshes the LCD panel 316 within the lower and upper bounds for the refresh frequency of the display device is implemented within the display device. For example, the display 310 may be configured to adjust the dynamic refresh frequency of the display 310 by repeatedly causing the LCD panel 316 to be refreshed by redisplaying the previous image in order to keep the dynamic refresh frequency within the lower and upper bounds for the refresh frequency of the display 310. In such an embodiment, the GPU 350 may simply transmit each image to the display 310 one time over the interface 340 and then the display 310 handles the logic for repeatedly displaying the image.

Again, the scaling unit 330 is configured to scale the images encoded in the video signals received via the interface 340 to match a native resolution of the display 310. As shown in FIG. 5, the scaling unit 330 may include a scaler 510, a local memory 520, and the region control unit 335. The scaling unit 330 may be a fixed function hardware unit embodied on an ASIC (application specific integrated circuit) included in the display 310. In another embodiment, the scaling unit 330 may be included on a larger ASIC that includes the TCON 320. In one embodiment, the local memory 520 includes on-chip DRAM used to store image data. In another embodiment, the local memory 520 includes a cache associated with off-chip DRAM accessible by the scaling unit 330 via an interface. Image data may be stored in the off-chip DRAM and fetched into the cache as needed.

The scaler 510 may receive each image at a resolution generated by the GPU 350. The scaler 510 may determine the resolution of the images by analyzing the video signal (i.e., counting the number of pixels between horizontal synchronization signals and/or vertical synchronization signals), or the scaler 510 may receive a configuration signal from the GPU 350 over the interface 340 that specifies a resolution of the images transmitted over the interface 340. The scaler 510 may then scale the images from the original resolution provided by the GPU 350 to the native resolution of the display 310. When the original resolution matches the native resolution, then no scaling of the images may be required. The scaled image data may be generated via, e.g., interpolating one or more values in the original image data to generate values for each pixel location in the scaled image data at the native resolution. The image data may be stored in the local memory 520 and filtered (e.g., interpolated, etc.) to generate scaled image data. The scaled image data is output with one or more polarity control signals generated by the region control unit 335 and the scaled image data is output to the TCON 320 to be displayed on the LCD panel 316 using the polarity specified by the polarity control signals.

In one embodiment, the region control unit 335 is also configured to manage dynamic frame repetition based on the minimum and maximum allowed frame durations of the display 310. The display 310 may be configured to ensure that the LCD panel 316 is refreshed at a rate that falls between the lower and upper bounds for the refresh frequency of the display, even though the incoming video signal may not adhere to these requirements. In such an embodiment, the GPU 350 may be configured to simply transmit the image data to the display 310 when the image data have been fully rendered into the frame buffer. Image data for each image may only be transmitted to the display 310 one time. Once the scaling unit 330 has caused a previous image to be presented on the LCD panel 316, the scaling unit 330 may calculate an estimate for the current image duration.

In one embodiment, the scaling unit 330 determines the image durations associated with each image included in the video signal by calculating a delay between the start of each image received by the scaling unit 330 via the interface 340, utilizing, e.g., a system clock included in the display 310 and timestamps associated with the images stored in the memory 420. The start of each image may be characterized by a vertical synchronization signal included in the video signal that cause the display 310 to store a timestamp in the memory 420 that indicates a time associated with the start of that image.

In another embodiment, the GPU 350 transmits metadata associated with each image that includes the image duration for the previous image in the video signal transmitted via the interface 340. The scaling unit 330 reads the image durations from the video signal and determines an estimate for the current image duration based on one or more image durations received in the video signal. Once the scaling unit 330 has determined an estimate for the current image duration, a refresh timeout may be calculated. The refresh timeout will control the number of times that the previous frame of image data is repeated. Then the scaling unit 330 may cause the scaled image data for the previous image to be repeatedly displayed depending on the refresh timeout value.

Figure 6:
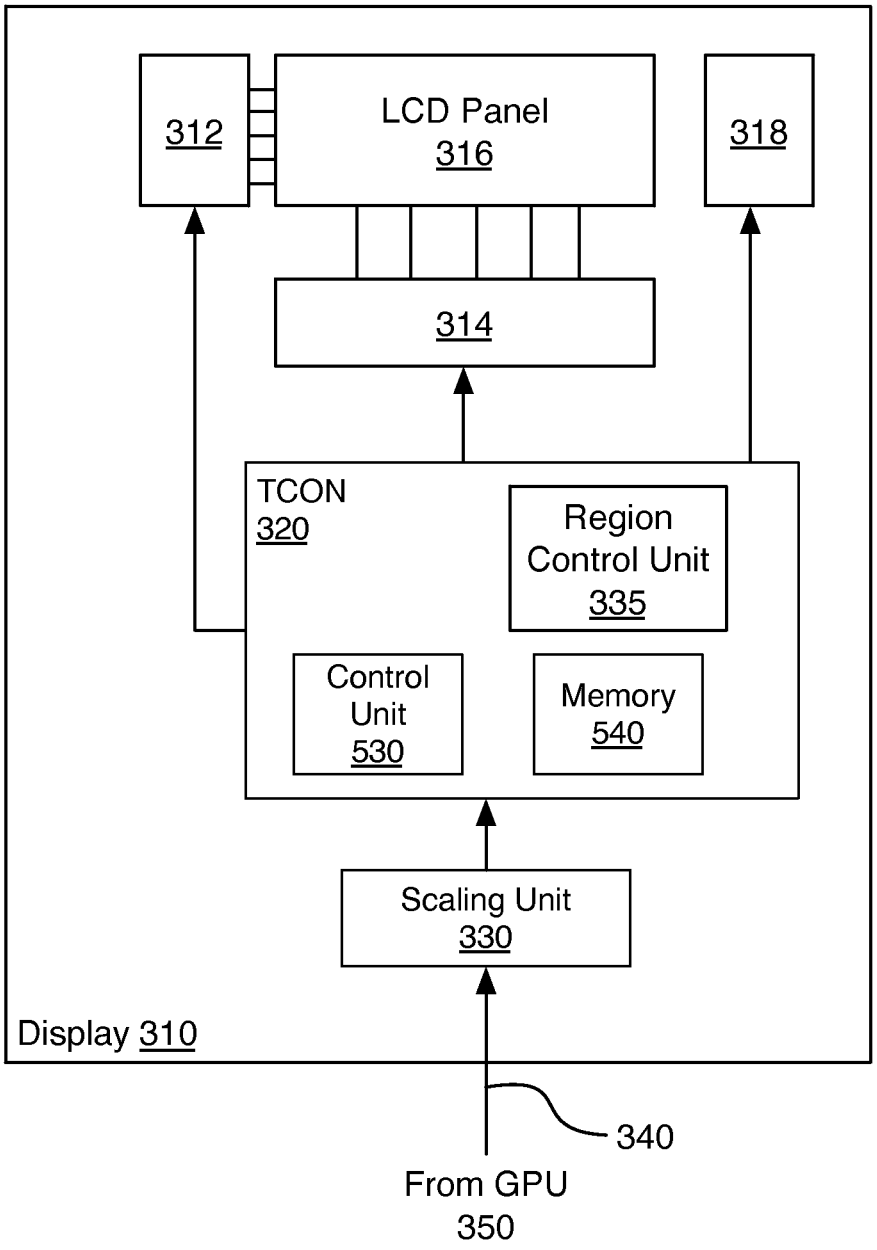
FIG. 6 illustrates the operation of the TCON of FIG. 3C, in accordance with another embodiment.

FIG. 6 illustrates the operation of the TCON 320 of FIG. 3C, in accordance with another embodiment. In yet another embodiment, the logic for ensuring that the display device refreshes the LCD panel 316 within the lower and upper bounds for the refresh frequency of the display device (i.e., the region control unit 335) is implemented within the TCON 320 instead of the scaling unit 330.

The TCON 320 includes the region control unit 335, a control unit 530, and memory 540. The memory 540 may include DRAM and/or registers. The TCON 320 may be a fixed function hardware unit embodied on an ASIC (application specific integrated circuit) included in the display 310. In another embodiment, the TCON 320 may be included on a larger ASIC that includes the region control unit 335 and the scaling unit 330. The control unit 530 is configured to transmit signals to the row drivers 312 and column drivers 314 based on the scaled image data received from the scaling unit 330. The TCON 320 receives scaled image data from the scaling unit 330, where the scaled image data is received in, e.g., row major order one component value at a time. The control unit 530 then addresses specific pixels utilizing the row drivers 312 and column drivers 314 to change the value of each pixel in the LCD panel 316 based on the scaled image data. The region control unit 335 controls the polarity used for displaying the scaled image data in each region of the LCD panel 316.

Once the TCON 320 has caused the scaled image data for the previous image to be presented on the LCD panel 316, the TCON 320 may calculate an estimate for the current image duration in a similar fashion to the manner implemented by the scaling unit 330, described above. In other words, the TCON 320 may calculate delay times between receiving each scaled image data from the scaling unit 330 and then estimate the current image duration based on the delay times associated with one or more previous scaled images. The scaling unit 330 may then use this estimate of the current image duration to calculate the refresh timeout. Finally, the refresh timeout may cause the previous scaled image to be repeatedly presented on the LCD panel 316.

In one embodiment, the TCON 320 may be associated with a refresh buffer that stores the scaled image data for the previous image as the scaled image data is received from the scaling unit 330. The refresh buffer may be implemented on the ASIC in memory 540. In another embodiment, the refresh buffer may be implemented in off-chip memory accessible by the TCON 320 via a cache in memory 540 and a memory interface. For example, the refresh buffer may be implemented within an external DRAM and portions of the refresh buffer may be fetched into a cache in memory 540 as needed. The stored scaled image data may then be read by the TCON 320 in order to present the scaled image(s) on the LCD panel 316.

Alternatively, the refresh buffer may be managed by the scaling unit 330. Instead of reading the scaled image data from a memory accessible by the TCON 320, the TCON 320 may be configured to transmit a signal to the scaling unit 330 that causes the scaling unit 330 to retransmit the scaled image data for the previous image to the TCON 320. In other words, the memory 520 associated with the scaling unit 330 may be utilized to implement the refresh buffer instead of storing the scaled image data redundantly.

It will be appreciated that, as described above, adjusting the dynamic refresh frequency of the display device based on the refresh timeout may be implemented by any one of the GPU 350, the scaling unit 330 of the display 310, or the TCON 320 of the display 310. Furthermore, the various embodiments described above may be implemented in the graphics processor 706 and display 708 of system 700, described below.

Figure 7:
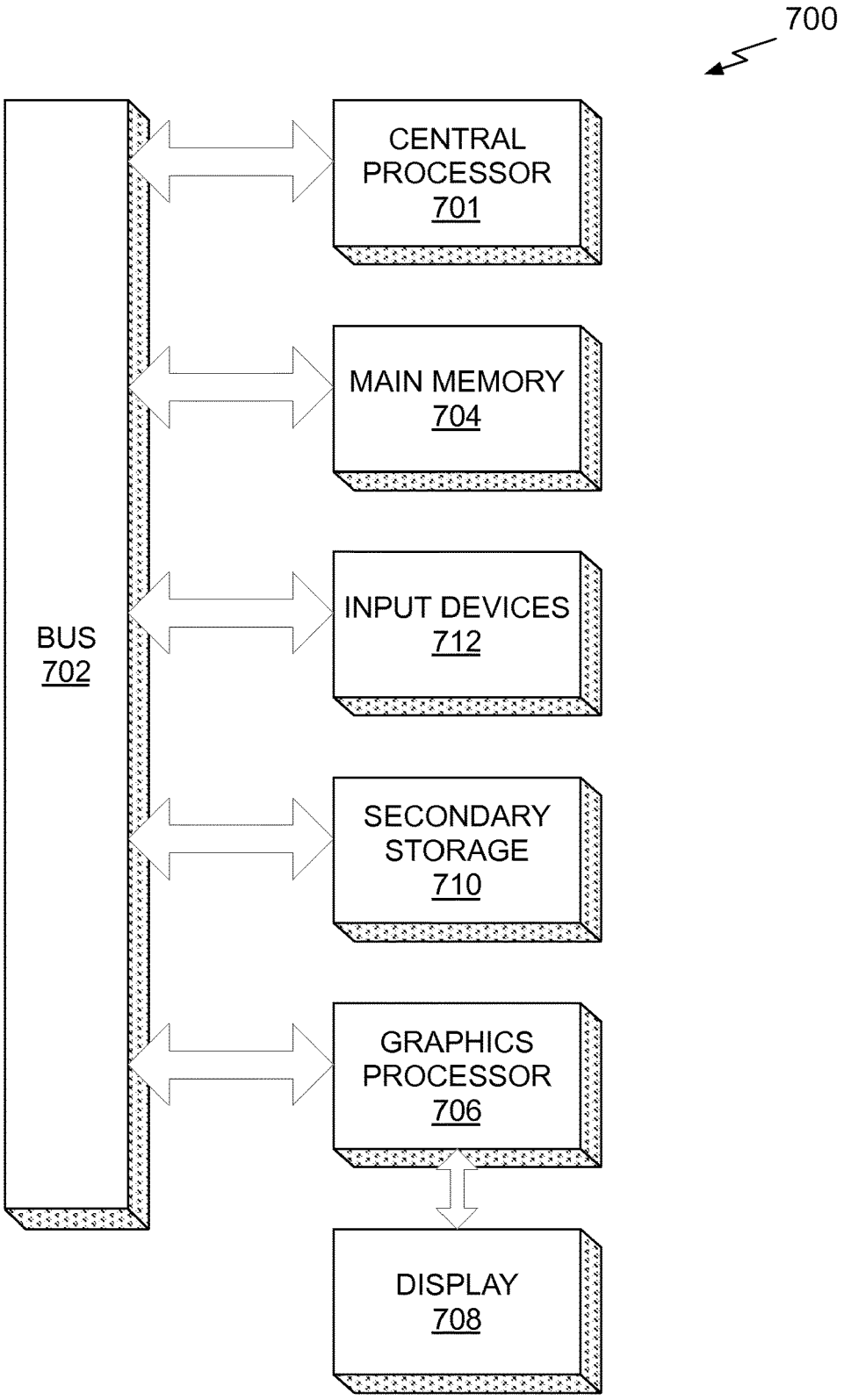
FIG. 7 illustrates an exemplary system in which the various architecture and/or functionality of the various previous embodiments may be implemented.

FIG. 7 illustrates an exemplary system 700 in which the various architecture and/or functionality of the various previous embodiments may be implemented. As shown, a system 700 is provided including at least one central processor 701 that is connected to a communication bus 702. The communication bus 702 may be implemented using any suitable protocol, such as PCI (Peripheral Component Interconnect), PCI-Express, AGP (Accelerated Graphics Port), HyperTransport, or any other bus or point-to-point communication protocol(s). The system 700 also includes a main memory 704. Control logic (software) and data are stored in the main memory 704 which may take the form of random access memory (RAM).

The system 700 also includes input devices 712, a graphics processor 706, and a display 708, i.e. a conventional CRT (cathode ray tube), LCD (liquid crystal display), LED (light emitting diode), plasma display or the like. User input may be received from the input devices 712, e.g., keyboard, mouse, touchpad, microphone, and the like. In one embodiment, the graphics processor 706 may include a plurality of shader modules, a rasterization module, etc. Each of the foregoing modules may even be situated on a single semiconductor platform to form a graphics processing unit (GPU).

In the present description, a single semiconductor platform may refer to a sole unitary semiconductor-based integrated circuit or chip. It should be noted that the term single semiconductor platform may also refer to multi-chip modules with increased connectivity which simulate on-chip operation, and make substantial improvements over utilizing a conventional central processing unit (CPU) and bus implementation. Of course, the various modules may also be situated separately or in various combinations of semiconductor platforms per the desires of the user.

The system 700 may also include a secondary storage 710. The secondary storage 710 includes, for example, a hard disk drive and/or a removable storage drive, representing a floppy disk drive, a magnetic tape drive, a compact disk drive, digital versatile disk (DVD) drive, recording device, universal serial bus (USB) flash memory. The removable storage drive reads from and/or writes to a removable storage unit in a well-known manner.

Computer programs, or computer control logic algorithms, may be stored in the main memory 704 and/or the secondary storage 710. Such computer programs, when executed, enable the system 700 to perform various functions. The memory 704, the storage 710, and/or any other storage are possible examples of computer-readable media.

In one embodiment, the architecture and/or functionality of the various previous figures may be implemented in the context of the central processor 701, the graphics processor 706, an integrated circuit (not shown) that is capable of at least a portion of the capabilities of both the central processor 701 and the graphics processor 706, a chipset (i.e., a group of integrated circuits designed to work and sold as a unit for performing related functions, etc.), and/or any other integrated circuit for that matter.

Still yet, the architecture and/or functionality of the various previous figures may be implemented in the context of a general computer system, a circuit board system, a game console system dedicated for entertainment purposes, an application-specific system, and/or any other desired system. For example, the system 700 may take the form of a desktop computer, laptop computer, server, workstation, game consoles, embedded system, and/or any other type of logic. Still yet, the system 700 may take the form of various other devices including, but not limited to a personal digital assistant (PDA) device, a mobile phone device, a television, etc.

Further, while not shown, the system 700 may be coupled to a network (e.g., a telecommunications network, local area network (LAN), wireless network, wide area network (WAN) such as the Internet, peer-to-peer network, cable network, or the like) for communication purposes.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

displaying a first portion of a first image on a first region of a screen of a variable refresh rate display device using a spatial inversion pattern and a temporal polarity pattern comprising a polarity inversion mask, wherein a first bit in the polarity inversion mask controls reversing of polarities specified by the spatial inversion pattern for pixels within the first region; and displaying a second portion of the first image on a second region of the screen of the variable refresh rate display device using the spatial inversion pattern and the temporal polarity pattern, wherein a second bit in the polarity inversion mask controls reversing of the polarities specified by the spatial inversion pattern for pixels within the second region.

2. The method of claim 1, wherein the first region comprises one or more rows of pixels in the screen of the variable refresh rate display device, and the second region comprises one or more additional rows of pixels in the screen of the variable refresh rate display device.

3. The method of claim 1, wherein the second bit is determined based on a DC balance characteristic associated with the second region of the screen of the variable refresh rate display device.

4. The method of claim 1, further comprising:
receiving a second image; and
interrupting display of the first image between the second region and a third region of the screen of the variable refresh rate display device.

5. The method of claim 4, further comprising displaying a first portion of the second image on the first region of the screen of the variable refresh rate display device using the spatial inversion pattern as reversed by the temporal polarity pattern.

6. The method of claim 4, wherein the third region of the screen of the variable refresh rate display device is adjacent to and immediately below the second region on the screen of the variable refresh rate display device, and the third region comprises one or more additional rows of pixels in the screen of the variable refresh rate display device that are not included in the first region or the second region.

7. The method of claim 4, further comprising, after interrupting the display, updating state data to indicate that a polarity reversal boundary is between the second region and the third region.

8. The method of claim 4, further comprising updating a start redisplay value to correspond to a third region of the screen of the variable refresh rate display device.

9. The method of claim 8, further comprising:
displaying the second image on the screen of the variable refresh rate display device;
determining a refresh timeout has occurred; and
redisplaying the second image starting at the third region.

10. The method of claim 1, wherein the variable refresh rate display device is one of a liquid crystal display (LCD), a light emitting diode (LED) display, an organic light emitting diode (OLED) display, and an active-matrix OLED (AMOLED) display.

11. The method of claim 1, further comprising:
receiving a second image during display of the second portion of the first image; and
displaying a first portion of the second image on the first region of the screen of the variable refresh rate display device using the spatial inversion pattern and the temporal polarity pattern.

12. A non-transitory computer-readable storage medium storing instructions that, when executed by a processor, cause the processor to perform steps comprising:
displaying a first portion of a first image on a first region of a screen of a variable refresh rate display device using a spatial inversion pattern and a temporal polarity pattern comprising a polarity inversion mask, wherein a first bit in the polarity inversion mask controls reversing of polarities specified by the spatial inversion pattern for pixels within the first region; and
displaying a second portion of the first image on a second region of the screen of the variable refresh rate display device using the spatial inversion pattern and the temporal polarity pattern, wherein a second bit in the polarity inversion mask controls reversing of the polarities specified by the spatial inversion pattern for pixels within the second region.

13. The non-transitory computer-readable storage medium of claim 12, wherein the second bit is determined based on a DC balance characteristic associated with the second region of the screen of the variable refresh rate display device.

14. The non-transitory computer-readable storage medium of claim 12, further comprising:
receiving a second image; and
interrupting display of the first image between the second region and a third region of the screen of the variable refresh rate display device.

15. A system, comprising:
a variable refresh rate display device configured to:
display a first portion of a first image on a first region of a screen of the variable refresh rate display device using a spatial inversion pattern and a temporal polarity pattern comprising a polarity inversion mask, wherein a first bit in the polarity inversion mask controls reversing of polarities specified by the spatial inversion pattern for pixels within the first region; and
display a second portion of the first image on a second region of the screen of the variable refresh rate display device using the spatial inversion pattern and the temporal polarity pattern, wherein a second bit in the polarity inversion mask controls reversing of the polarities specified by the spatial inversion pattern for pixels within the second region.

16. The system of claim 15, wherein the second bit is determined based on a DC balance characteristic associated with the second region of the screen of the variable refresh rate display device.

17. The system of claim 15, wherein the variable refresh rate display device is further configured to:
receive a second image; and
interrupt display of the first image between the second region and a third region of the screen of the variable refresh rate display device.

18. The system of claim 15, further comprising a graphics processing unit (GPU) that is coupled to the variable refresh rate display device and configured to generate the first image and the second image.

* * * * *